US007739818B2

(12) United States Patent
Logan et al.

(10) Patent No.: US 7,739,818 B2
(45) Date of Patent: Jun. 22, 2010

(54) ILLUMINATED SIGN INSERT

(75) Inventors: Mark Logan, Atlanta, GA (US); Paul Kenneth Pickard, Apex, NC (US); Mark Wedell, Wilmington, NC (US)

(73) Assignee: ABL IP Lighting, LLC, Conyers, GA (US)

( * ) Notice: Subject to any disclaimer, the term of this patent is extended or adjusted under 35 U.S.C. 154(b) by 310 days.

(21) Appl. No.: 11/706,605

(22) Filed: Feb. 14, 2007

(65) Prior Publication Data

US 2007/0236941 A1 Oct. 11, 2007

Related U.S. Application Data

(60) Provisional application No. 60/773,294, filed on Feb. 14, 2006.

(51) Int. Cl.
*G09F 13/04* (2006.01)

(52) U.S. Cl. ..... 40/570; 40/572; 362/296.05; 362/368

(58) Field of Classification Search ..... 40/570, 40/564, 572, 573, 568; 362/296.05, 430, 362/652, 655, 656
See application file for complete search history.

(56) References Cited

U.S. PATENT DOCUMENTS

| | | | | |
|---|---|---|---|---|
| 1,469,946 | A | 10/1923 | Morrison | |
| 1,809,243 | A | 6/1931 | Kirk | |
| 1,887,523 | A | 11/1932 | Schenkel | |
| 3,296,431 | A | 1/1967 | Green | |
| 3,894,225 | A | 7/1975 | Chao | |
| 3,931,689 | A * | 1/1976 | Shine | 40/570 |
| 3,984,931 | A | 10/1976 | Belokin, Jr. | |
| 4,265,039 | A | 5/1981 | Brooks | |
| 4,298,869 | A | 11/1981 | Okuno | |
| 4,376,966 | A | 3/1983 | Tieszen | |
| 4,435,743 | A | 3/1984 | Plumly | |
| 4,466,208 | A | 8/1984 | Logan, Jr. et al. | |
| 4,482,944 | A | 11/1984 | Roossine et al. | |
| 4,549,253 | A | 10/1985 | Totten | |
| 4,650,265 | A | 3/1987 | Holtzman | |
| 4,682,147 | A | 7/1987 | Bowman | |
| 4,761,720 | A | 8/1988 | Solow | |
| 4,887,074 | A | 12/1989 | Simon et al. | |
| 4,994,944 | A | 2/1991 | Vernondier | |
| 5,018,290 | A | 5/1991 | Kozek et al. | |

(Continued)

FOREIGN PATENT DOCUMENTS

EP 0019486 A1 11/1980

(Continued)

OTHER PUBLICATIONS

KXTE Advertisement (original date not available; printed from website in Nov. 2009).

*Primary Examiner*—Lesley Morris
*Assistant Examiner*—Kristina Staley
(74) *Attorney, Agent, or Firm*—Kilpatrick Stockton, LLP

(57) ABSTRACT

There is provided a sign insert that can house the inner components of a sign. The insert can be easily inserted into and removed from signs so that either of the sign housing or the sign insert with inner components can be salvaged and reused if the other becomes inoperable.

23 Claims, 27 Drawing Sheets

U.S. PATENT DOCUMENTS

| | | | | | |
|---|---|---|---|---|---|
| 5,040,320 | A | | 8/1991 | Reidlnger | |
| 5,151,679 | A | | 9/1992 | Dimmick | |
| 5,161,882 | A | | 11/1992 | Garrett | |
| 5,217,293 | A | | 6/1993 | Kobzeff | |
| 5,272,605 | A | * | 12/1993 | Johnstone | 362/147 |
| 5,276,591 | A | | 1/1994 | Hegarty | |
| 5,365,411 | A | * | 11/1994 | Rycroft et al. | 362/20 |
| 5,404,279 | A | | 4/1995 | Wood | |
| 5,463,280 | A | | 10/1995 | Johnson | |
| 5,485,145 | A | | 1/1996 | Sniff | |
| 5,526,251 | A | | 6/1996 | Andre et al. | |
| 5,539,623 | A | | 7/1996 | Gurz et al. | |
| 5,655,830 | A | | 8/1997 | Rusouski | |
| 5,688,042 | A | | 11/1997 | Madadi et al. | |
| 5,707,136 | A | | 1/1998 | Byers | |
| 5,726,535 | A | | 3/1998 | Yan | |
| 5,765,938 | A | | 6/1998 | Rousso et al. | |
| 5,768,814 | A | | 6/1998 | Kozek et al. | |
| 5,797,673 | A | | 8/1998 | Logan et al. | |
| 5,884,997 | A | | 3/1999 | Stanuch et al. | |
| 5,897,194 | A | | 4/1999 | Ham | |
| 5,949,347 | A | | 9/1999 | Wu | |
| 5,964,051 | A | * | 10/1999 | Loeber et al. | 40/570 |
| 6,036,336 | A | | 3/2000 | Wu | |
| 6,135,620 | A | | 10/2000 | Marsh | |
| 6,152,581 | A | | 11/2000 | Masters et al. | |
| 6,167,648 | B1 | | 1/2001 | Dimmick | |
| 6,183,104 | B1 | | 2/2001 | Ferrara | |
| 6,234,641 | B1 | | 5/2001 | Ungard | |
| 6,241,369 | B1 | | 6/2001 | Mackiewicz | |
| 6,367,179 | B1 | | 4/2002 | Marsh | |
| 6,376,770 | B1 | * | 4/2002 | Hyde | 174/58 |
| 6,471,388 | B1 | | 10/2002 | Marsh | |
| 6,499,866 | B1 | | 12/2002 | Logan et al. | |
| 6,539,657 | B1 | * | 4/2003 | Qualls et al. | 40/546 |
| 6,557,283 | B1 | * | 5/2003 | Canfield | 40/564 |
| 6,616,310 | B1 | | 9/2003 | Marsh | |
| 6,659,623 | B2 | | 12/2003 | Friend | |
| 6,715,225 | B1 | | 4/2004 | Frolov et al. | |
| 6,796,680 | B1 | | 9/2004 | Showers et al. | |
| 6,824,295 | B1 | | 11/2004 | Grondal | |
| 6,848,798 | B1 | | 2/2005 | Logan et al. | |
| 7,350,327 | B1 | * | 4/2008 | Logan et al. | 40/570 |
| 2007/0277411 | A1 | * | 12/2007 | Logan et al. | 40/541 |

FOREIGN PATENT DOCUMENTS

| | | | |
|---|---|---|---|
| EP | 0994292 | A2 | 4/2000 |
| EP | 1199514 | A2 | 4/2002 |
| WO | WO 00/70592 | | 11/2000 |
| WO | WO 01/52224 | A1 | 7/2001 |
| WO | WO 02/16826 | A1 | 2/2002 |
| WO | WO 03/088421 | | 10/2003 |

* cited by examiner

ILLUMINATED SIGN INSERT

This application claims the benefit of U.S. Provisional Application Ser. No. 60,773,294, filed Feb. 14, 2006 titled "Illuminated Sign and Mounting Structure," the entire contents of which are hereby incorporated by reference.

FIELD OF THE INVENTION

This invention relates to a removable insert for illuminated signs and to mounting devices for mounting illuminated signs to a junction box in a ceiling or wall.

BACKGROUND OF THE INVENTION

Illuminated signs are used in a variety of environments and serve a variety of purposes. One of the most common purposes is to provide illumination in an emergency situation. Emergency lighting capability is mandated by commercial building codes throughout most of the world. The most common type of emergency lighting is the exit sign, which is intended to be illuminated at all times and clearly direct those in flight to the nearest exit during a fire or other emergency. Exit signs are typically placed above doorways or in egress paths to indicate the most efficient manner of exiting a building. A simple "EXIT" message can be provided on a sign located directly above the egress from the building or, where the egress is located away from the sign, an "EXIT" message is normally coupled on the sign with a directional indicator, such as a chevron, that points toward the closest exit.

A variety of exit signs are available and in use today. Exit signs are typically made of die cast metal or molded of a polymer material. Moreover, the benefits of exit signs in certain environments have been enhanced by attaching additional emergency lighting on the sign housing, such as is disclosed in U.S. Pat. No. 5,797,673.

While exit signs may come in all shapes and sizes and with a variety of accessories, U.S. Pat. No. 6,152,581 discloses a representative structure of an exit sign. FIG. 1 of U.S. Pat. No. 6,152,581 (reproduced as FIG. 1 herein for ease of discussion, but with reference numerals changed) illustrates an exit sign 1 having a housing frame 2, a front cover plate 4, and a rear mounting plate 8. The front and rear plates 4, 8 attach to the housing frame 2 to form the exit sign structure, which houses the necessary components for operation such as illuminations sources, electrical circuitry, power sources (such as batteries), and other structural elements necessary to illuminate the sign.

In this example, a legend 6 (with the letters "E", "X", "I", and "T") is formed on the front cover plate 4. To ensure that the exit message legend is easily seen, a planar panel 3 is mounted on the interior surface of front cover plate 4. The panel 3 is typically made from a light-transmitting plastic that appears different from the cover plate 4, such as a transparent or translucent material, and is preferably of an eye-catching color (such as red or green) that is easily seen through the legend. In use, light is generated by a power source housed inside the exit sign 1. The light inside the exit sign 1 causes the legend 6 to glow with the color of the panel 3, rendering the exit sign 1 more noticeable, especially in the event of a power outage in the building.

Installation of illuminated signs can be difficult. For example, once the junction box has been installed, there is often a complicated hanging structure—with multiple parts—that needs to be installed over the junction box in order to secure the sign in place. Because the installer is usually standing on a ladder, having multiple parts to contend with can be difficult and time consuming.

Specifically, a mounting device, such as those disclosed in U.S. patent application Ser. No. 10/763,035 entitled "Mounting Devices for Exit Signs and Other Fixtures" connects an illuminated sign, such as an exit sign, to a junction box. Junction boxes are typically recessed within or otherwise mounted to ceilings or walls and are connected to a power source. Electrical wiring from the junction box can be pulled through the mounting device and into the interior of the sign for connecting electrical components in the sign to a main power source. Then, in order to secure the sign to the mounting device, a series of screws, bolts, and other securing devices are used. Accordingly, there is a need in the art for an illuminated sign housing that provides a greater ease of installation.

Moreover, unlike plastic signs, exit signs made from metal are relatively heavy. Thus, when mounted on a ceiling or wall, they have a tendency to sag or pull from the ceiling or wall and pull their mounting devices with them so that the junction box is exposed. Thus, attempts have been made to bias the signs toward the ceiling or wall surface from which they protrude, and thereby ensure that the junction box is covered from view in the finished installation. For example, in the past a pipe fitting was fed into a sign housing from the point of attachment (i.e., ceiling or wall). A lock washer and nut were mounted on the pipe fitting and the nut was tightened to bias the sign towards the ceiling or wall. Such an arrangement required manipulation of a number of parts and consequently increased the time and cost of sign installation. Moreover, the pipe fittings cast shadows in the sign that negatively impacted visibility of the illuminated legend. Accordingly, there is also a need in the art for illuminated signs that have a secure connection to the wall, ceiling, or other mounting surface, such that the sign can be mounted and biased toward the mounting surface to prevent any sagging.

Another challenge with current illuminated signs in that the inner components of the sign, such as illumination sources, electrical circuitry, power sources (such as batteries), and other structural elements necessary to illuminate the sign, have traditionally been mounted directly to the housing frame. Thus, should the sign housing be irreparably damaged, it is typically discarded even though the inner components are still functional. Similarly, should the inner components fail, the entire sign must be replaced even though the sign housing is still operable. Accordingly, it is desirable to provide a separate sign insert that can house inner components separately from the outer sign housing.

SUMMARY OF THE INVENTION

Embodiments of the present invention provide sign mounting devices that cover junction boxes of various configurations and provide ease of installation as compared to current designs, as well as a pleasing, finished appearance to a resulting installation. One embodiment of a mounting device includes a mounting plate and a canopy element that is positioned over the mounting plate. The mounting plate is connected, such as with screws or other fasteners, to a junction box and is preferably configured so that it can be directly mounted to junction boxes of different configurations. The canopy element is then positioned over the mounting plate so that the screws or other fasteners that connect the junction box to the mounting plate are covered in a finished installation by outer portions of the canopy element of the mounting device, and thus, are not visible. In one embodiment, the mounting plate and the canopy element are secured together (and to the sign) by a locking clip. In an alternate embodiment, they are secured together (and to the sign) by fasteners (which may be pins, screws, tacks, or any other appropriate fastener that can be inserted through an opening).

In a further embodiment, structures may be provided on the sign (or the sign insert) and the mounting device to interact and to bias the mounting device towards the ceiling or wall to ensure that the junction box remains invisible in the finished installation, regardless of whether the junction box is correctly mounted (i.e., mounted flush with the wall or ceiling surface) or incorrectly mounted (i.e., recessed too deeply within or extending beyond the wall or ceiling surface).

Embodiments of the present invention also provide a removable insert for a sign that houses the inner components of the sign and that can easily be inserted into and removed from signs. In this way, either of the sign housing or sign insert with inner components can be salvaged and re-used when the other becomes inoperable.

The insert, which is preferably molded from a polymer material may include a structure to support the sign circuit board. For example, the insert may include grooves into which the circuit board can slide. Cavities may also be formed in the insert. These cavities can be used to store components traditionally mounted on the circuit board, such as batteries and voltage conversion devices, that often cast shadows across the legend (in this case "EXIT") and thus detrimentally impact illumination. The inner walls of the insert preferably closely conform to the shape of the exterior of the legend to increase the amount of the light transmitted through the legend. A structure may also be provided on the inner walls of the insert to distribute light more efficiently within the sign.

According to one aspect of embodiments of the invention, there is provided a removable insert adapted to fit within an illuminated sign comprising a sign housing and a sign legend to be displayed by the illuminated sign, the insert comprising:

(a) at least one inner wall and at least one outer wall, wherein the at least one outer wall is shaped to be inserted into the sign housing and the at least one inner wall is shaped so as not to encroach on the sign legend;

(b) at least one cavity defined between the at least one inner and outer wall, wherein the at least one cavity is adapted to house at least one sign component; and (c) at least one structure for supporting a circuit board.

The insert may have at least one inner wall substantially conforms to an exterior of the sign legend. It may also feature a reflector opposite a light source within the sign housing. The reflector may comprise two angled side walls oriented relative to each other and forming a cavity. In one embodiment, the angled side walls are oriented between about 40 degrees to about 120 degrees relative to each other. The reflector may also have an inverted tip. In various embodiment, the reflector may be integrally formed with the insert, removable from the insert, or hingedly attached to the insert.

In other embodiments, the insert snap fits into the sign housing. This may be accomplished via at least one cooperating protrusion and recess system located on portions of the removable insert and the sign housing.

There may be provided at least one structure that supports the circuit board comprises grooves into which the circuit board can slide.

There may also be provided at least one cavity that is adapted to store one or more of a battery, a voltage conversion device, an additional power supply, a directional indicator assembly, or a speaker.

Embodiments of the insert may further comprise at least one biasing structure to secure the insert to a mounting device. In some embodiments, the at least one biasing structure is a spring.

Other aspects of the invention relate to an illuminated sign system comprising a sign housing and the removable insert of claim 1 positioned within the sign housing.

The sign insert may cooperate with a mounting device. In one embodiment, the mounting device with which the insert cooperates comprises:

(a) a mounting plate comprising a mounting base having at least one positioning element and at least one lip element formed thereon;

(b) a canopy element adapted to be positioned over the mounting plate, the canopy element comprising (i) at least one positioning element aperture adapted to receive the at least one positioning element; (ii) at least one lip element aperture adapted to receive the at least one lip element; and (iii) at least one upstanding stabilizing element extending from an upper surface of the canopy; and (c) a locking clip adapted to cooperate with at least a portion of the mounting plate and the canopy element.

The insert may have at least one side wall with at least one guide track defined therein, and wherein the locking clip has at least one leg with at least one tab that is adapted to be received in the at least one guide track.

The insert may also have at least one mounting aperture adapted to receive one of a mounting device or a plug that covers any unused mounting apertures. The plug may comprise a base from which at least one leg extends and wherein the at least one leg comprises a protrusion distal the base and adapted to engage a biasing structure on the sign insert.

Further aspects provide a method of assembling an illuminated sign comprising positioning a first removable insert according to claim 1 in a first illuminated sign. One embodiment comprises removing the first removable insert from the first illuminated sign and positioning the first removable insert in a second illuminated sign. Another embodiment comprises removing the first removable insert from the first illuminated sign and positioning a second removable insert according to claim 1 into the first illuminated sign. The insert may be adapted to be snap fit with respect to the first illuminated sign.

DETAILED DESCRIPTION OF THE INVENTION

Figure 1:
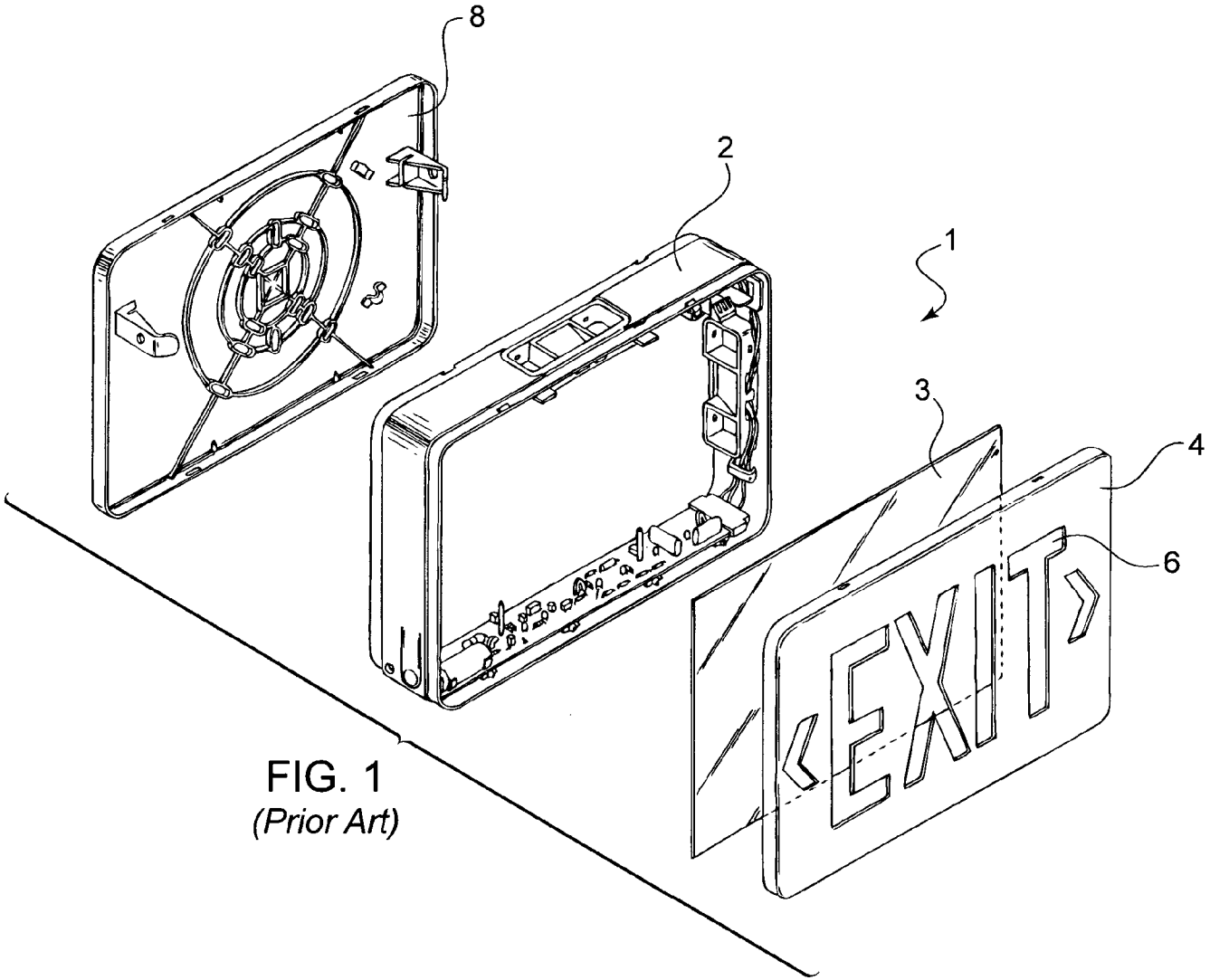
FIG. 1 (Prior Art)
FIG. 1 shows a representative structure of a prior art exit sign.
Figure 2:
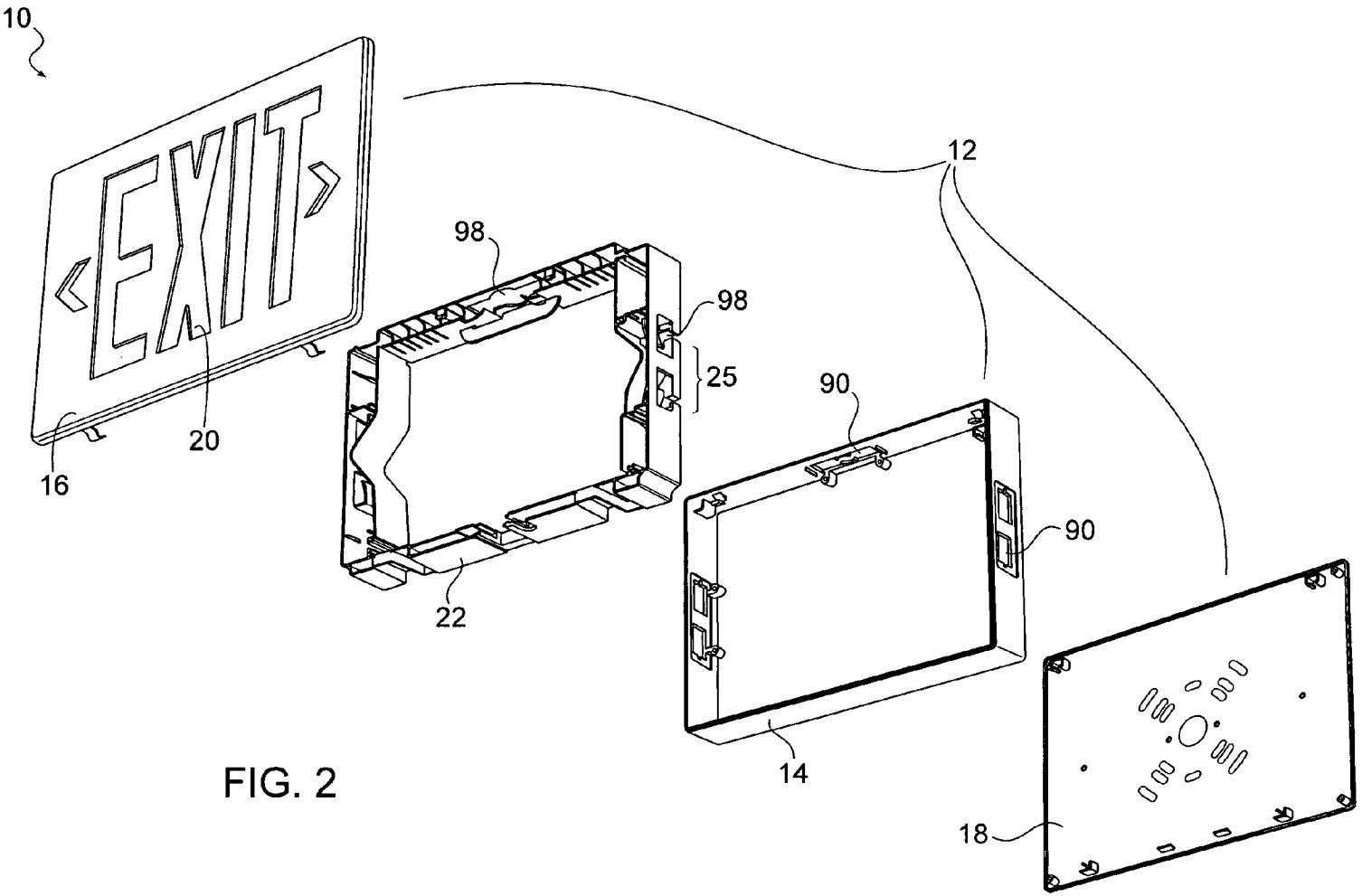
FIG. 2 shows one embodiment of a sign housing with a removable insert.

One embodiment of the invention includes a removable sign insert that is made to fit within an illuminated sign. While the insert may be used in any type of illuminated sign, for purposes of illustration and discussion, it is described for use with emergency exit signs. One such example of an exit sign 10 is shown in FIG. 2 and includes a sign housing 12 having a housing frame 14 and cover plates 16,18, at least one of which bears a sign legend 20. One of skill in the art will understand, however, that the insert could be used with other signs having internal electrical components.

Figure 3:
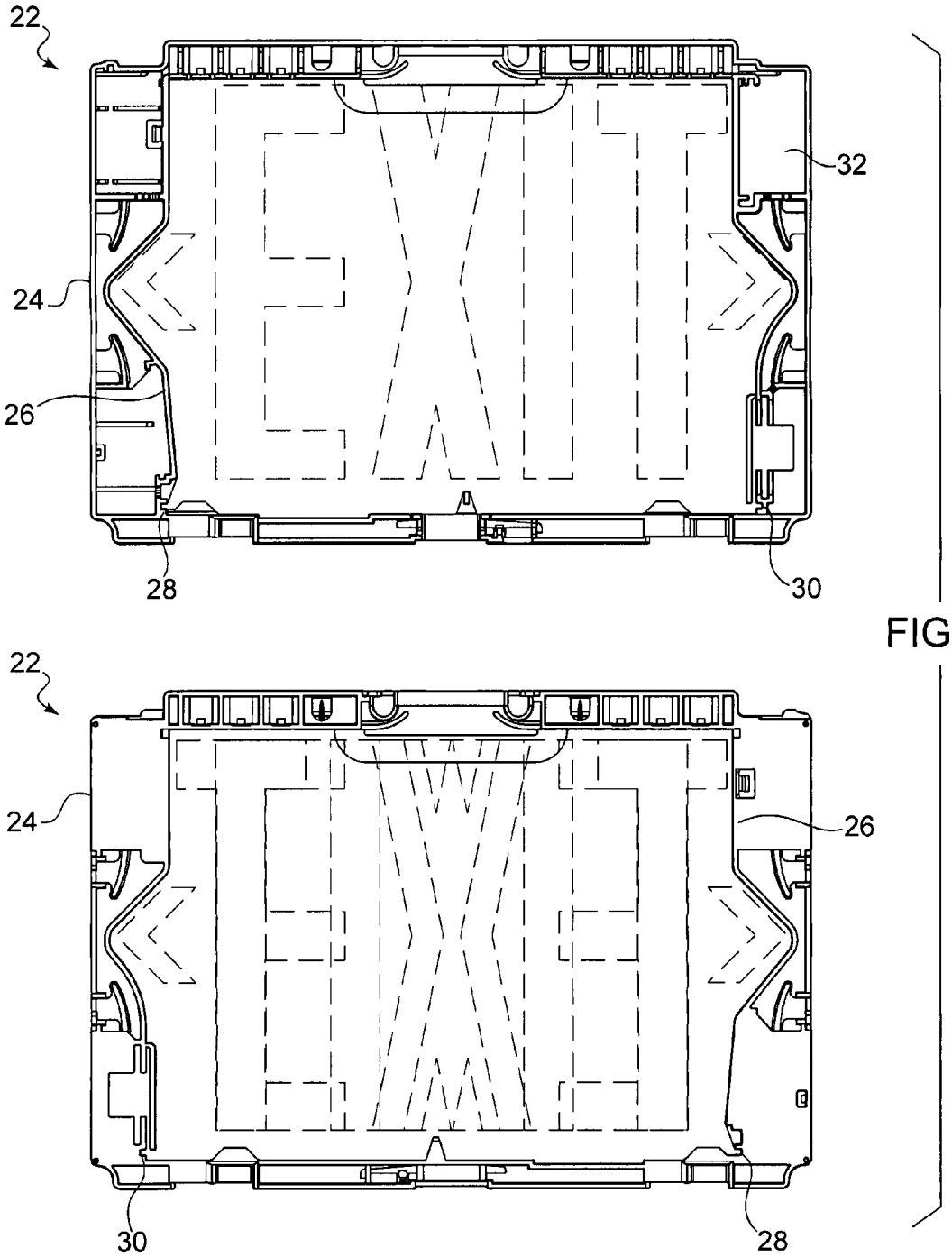
FIG. 3 shows a cross-sectional view of the insert of FIG. 2 from a front view and a back view.
Figure 4:
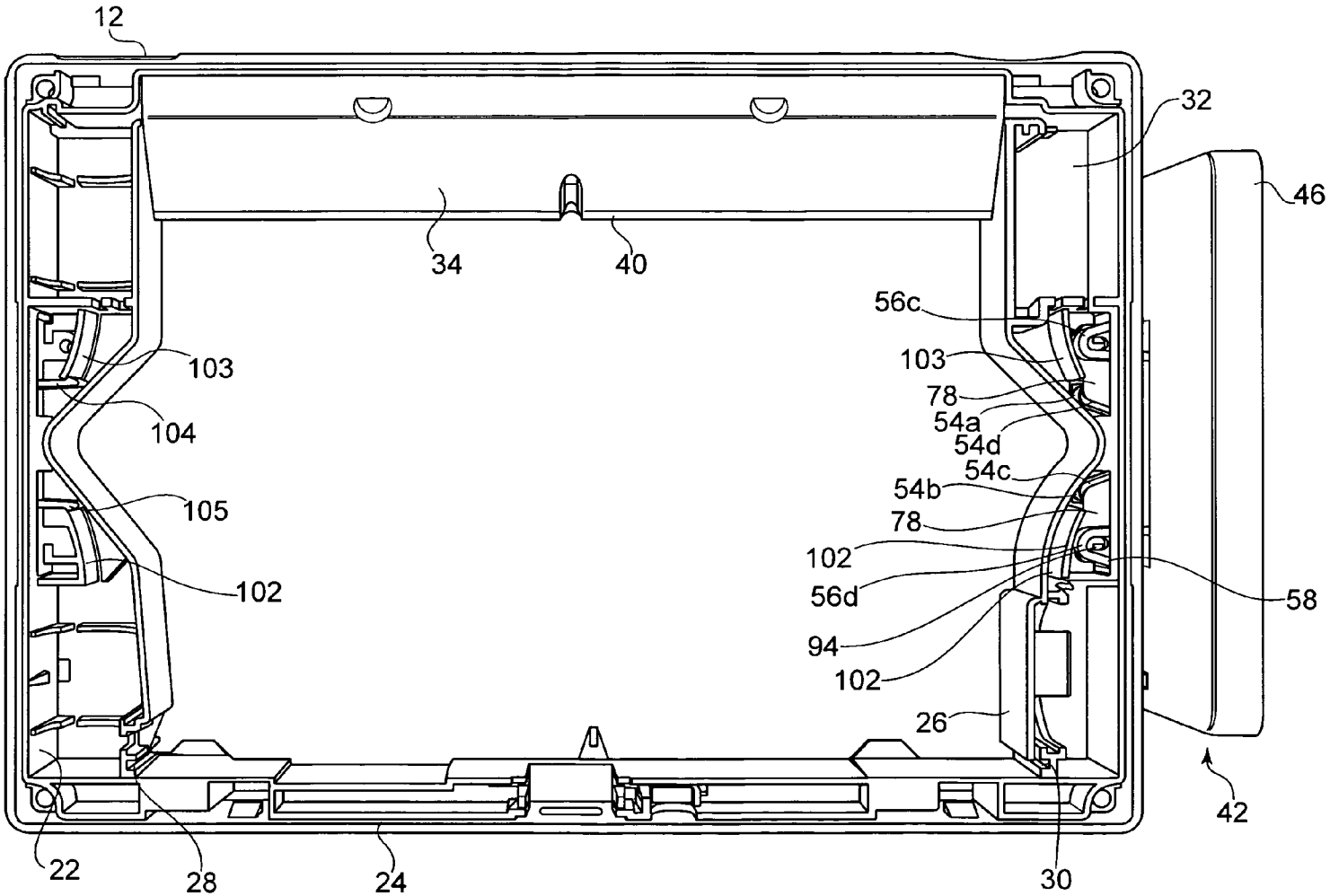
FIG. 4 shows a cross-sectional view of the assembled sign of FIG. 2, with one embodiment of a mounting device secured into an opening at its right side and a plug secured into an unused opening at its left side.

One embodiment of an insert 22 is shown in FIGS. 2-4. The insert 22 can be made from a variety of materials, including metal and plastic, but the insert is preferably molded from an opaque polymeric material having high reflectivity, such as acrylonitrile-butadiene-styrene ("ABS"), polycarbonate, ABS blended with polycarbonate, or any other material that meets UL specifications for enclosure of light parts, flammability standards, and electrical insulating capabilities. While the insert 22 may be used with plastic signs, it is particularly beneficial in use with metal sign housings.

As shown in FIG. 3, the insert 22 includes outer walls 24 and inner walls 26 and is shaped to be inserted into the sign housing 12 as shown in FIG. 4. Moreover, the insert 22 preferably snap-fits or friction fits into the sign housing 12 to prevent relative movement between the insert 22 and the sign 10. For example, protrusions (not shown) may be provided on the outer wall of the insert 22 or inner wall of the housing frame 14 to fit within recesses (not shown) on the other of the outer wall of the insert 22 or inner wall of the housing frame 14.

The inner walls 26 of the insert 22 are preferably located so as not to encroach into the sign legend 20 and thereby interfere with illumination of the legend 20. More preferably, the inner walls 26 of the insert 22 closely conform to the shape of the exterior of the legend 20 to reduce the amount of light deflected within the sign 10 and thereby increase the amount of light transmitted through the legend 20. As discussed below, other structures, such as a reflector, may be provided on the insert 22 or otherwise in the sign housing 12 to distribute light more efficiently within the sign 10 so that more light is focused evenly through the legend 20 thereby enhancing sign illumination and effectiveness.

The features provided in the insert 22 may vary depending on the sign for which the insert 22 is intended to be used. However, certain features are particularly useful. The insert 22 preferably includes circuit board mounting structure for retention of a circuit board in the insert. For example, grooves 28, 30 may be provided into which a circuit board may be inserted. Alternatively, a circuit board may be mounted on a ledge or other surface in the insert 22. The outer and inner walls 24, 26 of the insert 22 are preferably shaped to define cavities 32 there between. Any number of cavities 32 may be formed in the insert 22, and the cavities 32 may be used for a variety of purposes. For example, the cavities 32 can be used to store components traditionally mounted on the circuit board, such as batteries and voltage conversion devices, which often cast shadows across the legend 20 and detrimentally impact illumination. The cavities 32 may also be used to store additional batteries, a second power supply, a directional indicator assembly, a speaker, or any other appropriate component.

In some embodiments, the outer walls 24 have mounting device portions 25, as shown in FIG. 2. These portions 25 may be apertures 98 adapted to receive a screw, a clip, or one of the mounting structures described below. Alternatively, they may be protrusions or any other structure that will help secure sign to an appropriate mounting surface.

As shown in FIG. 4, a reflector 34 may also be integrally molded with or otherwise provided on the insert 22. The intensity of light is inversely proportional to the distance light travels. The light in exit signs is oftentimes generated by a light generating area, such as an area having light emitting diodes (LEDs) positioned closer to the bottom of the sign. Thus, the light loses intensity towards the top of the sign, and the legend is consequently typically less illuminated at the top of the sign than at the bottom of the sign. Providing a reflector 34 at the top of insert 22 helps to distribute the light emitted from the LEDs more evenly across the entire legend 22.

Figure 5A:
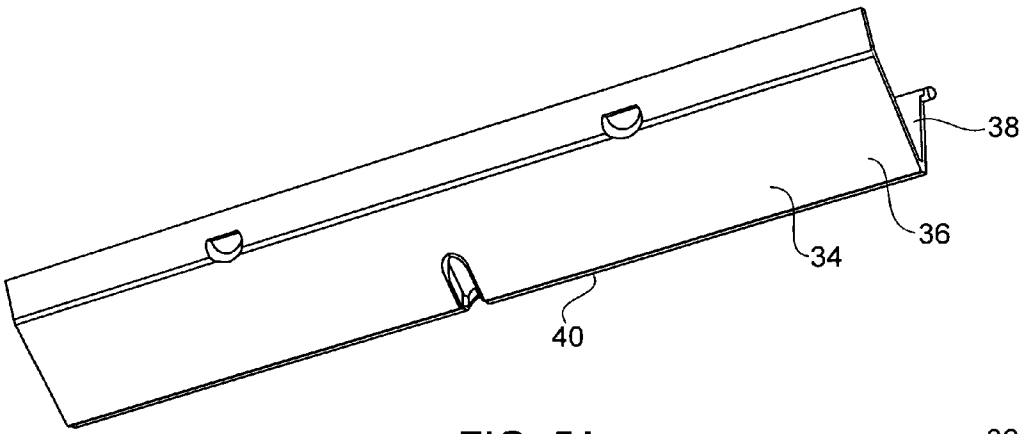
FIGS. 5A-C show alternate views of an embodiment of a reflector for use with a sign insert.
Figure 5C:
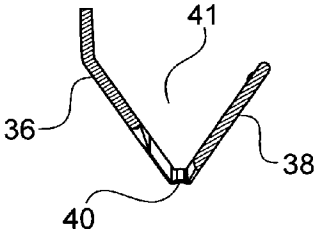
Figure 5B:
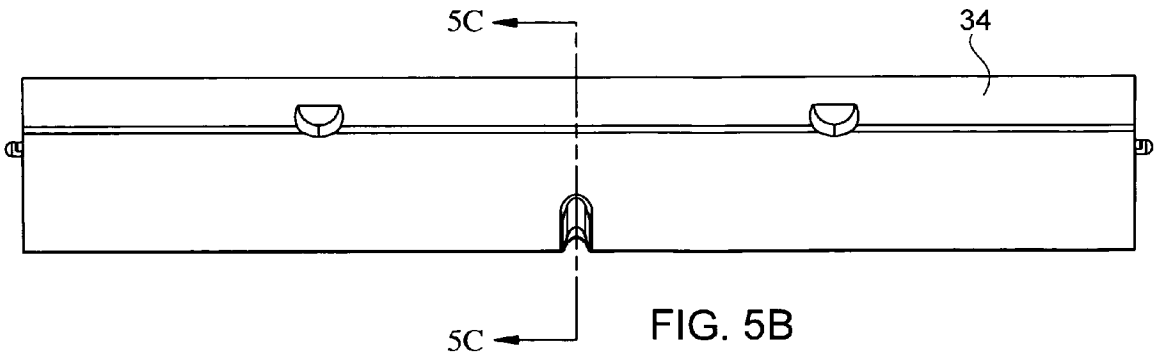

As shown in FIGS. 5A-C, the reflector 34 can be defined by two angled side walls 36, 38. In some embodiments, walls 36 and 38 are oriented relative to each other at an angle between about 40° and about 120°, inclusive. Some of the light emitted from the LEDs encounters the side walls 36, 38 of the reflector 34, which direct and reflect that light through the upper portion of the legend 20. The tip 40 of the reflector 34 (e.g., where side walls 36, 38 meet) may be rounded, flattened, inverted, or patterned (e.g., with ridges) to further control the reflection of light. The reflector 34 preferably includes, but does not have to include, an inverted tip 40, as shown in detail in FIG. 5C. Light emitted from the LEDs encounters the inverted tip 40 of the reflector, which directs and reflects that light through the middle portion of the legend 20. Sideband emissions from the LEDs illuminate the bottom portion of the legend 20. In this way, the light generated by the sign 10 is distributed more evenly across the face of the legend 20.

While the reflector 34 may be solid, it is preferably hollow to define a reflector cavity 41 between the side walls 36, 38 and an inner wall 26 of the insert 22. Wires may be routed through, or additional components stored in, the reflector cavity 41. Reflector 34 may be integrally-formed with the insert 22 or it may be completely removable from the insert 22 and/or hingedly attached on one side to the insert 22 to allow access to such wires and additional components.

A diffuser (not shown), such as that disclosed in U.S. Pat. No. 5,954,423 to Logan et al., may be positioned within the sign (such as over the circuit board) to further enhance sign illumination.

During manufacture, the inner components of an illuminated sign are assembled onto the insert 22. The pre-assembled insert 22 can then be quickly and easily installed in a sign housing 12. The insert is preferably designed to fit within a variety of exit signs. Thus, instead of custom-installing the major components on each type of sign, the components can be pre-assembled on the insert and the resulting universal insert can be installed in a variety of signs. Use of a sub-assembly line to pre-assemble the insert results in increased manufacturing efficiency and a reduction in manufacturing time and costs. Moreover, because the insert 22 is easily inserted into and removed from signs, either of the sign housing 12 or sign insert 22 can be salvaged and re-used when the other becomes inoperable. Thus, should the sign housing 12 be irreparably damaged, the insert 22 may be removed and reused. Alternatively, should the components on the insert 22 fail, the entire insert 22 can be removed and replaced with an insert having functional components that is placed back into the original sign housing 12.

Figure 6:
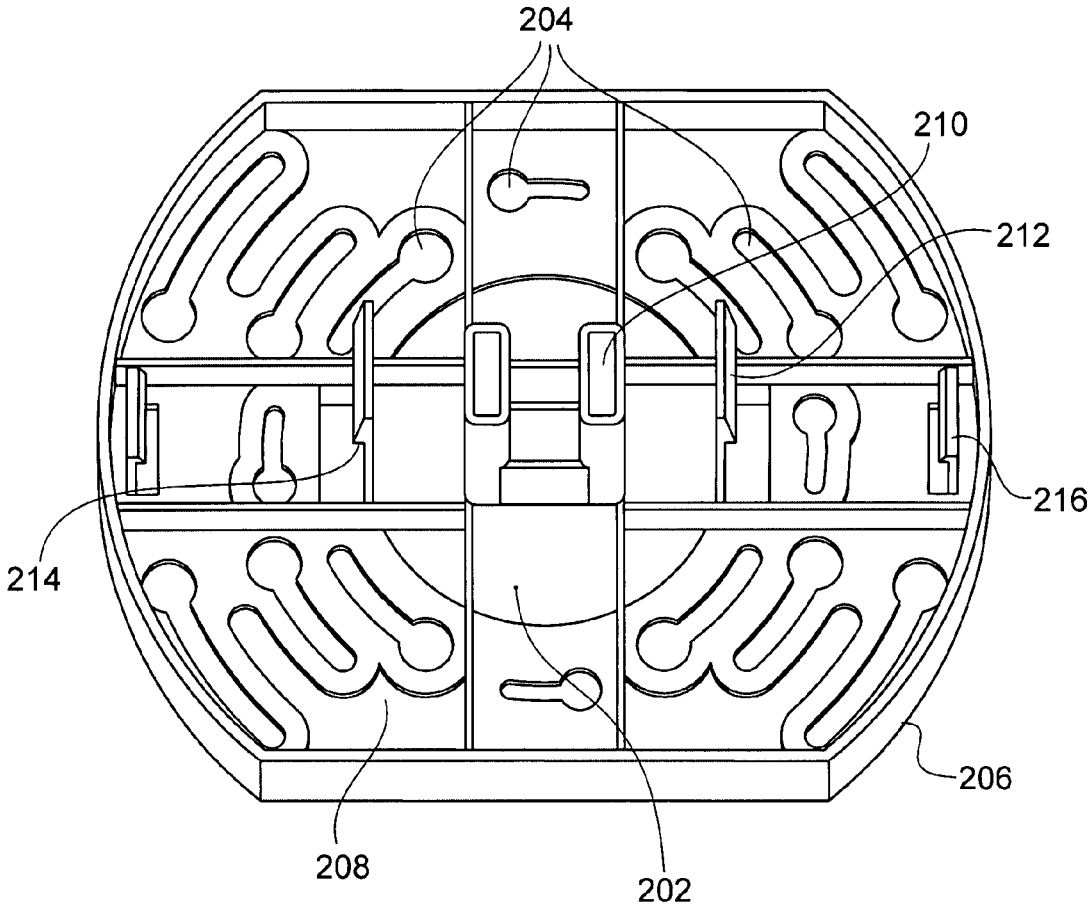
FIG. 6 shows a top perspective view of one embodiment of a mounting plate that can be used to form a mounting device.
Figure 7:
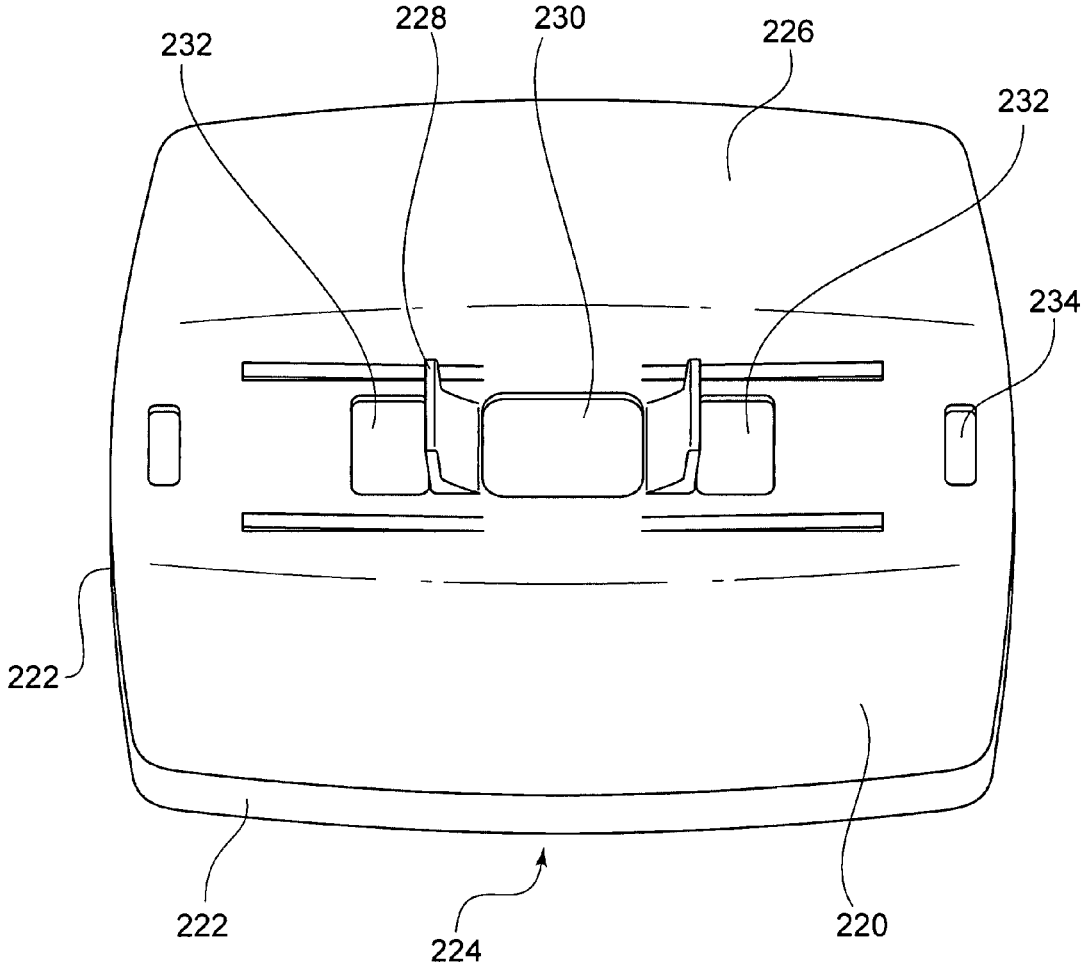
FIG. 7 shows a top perspective view of one embodiment of a canopy element that can be used to form a mounting device.
Figure 8:
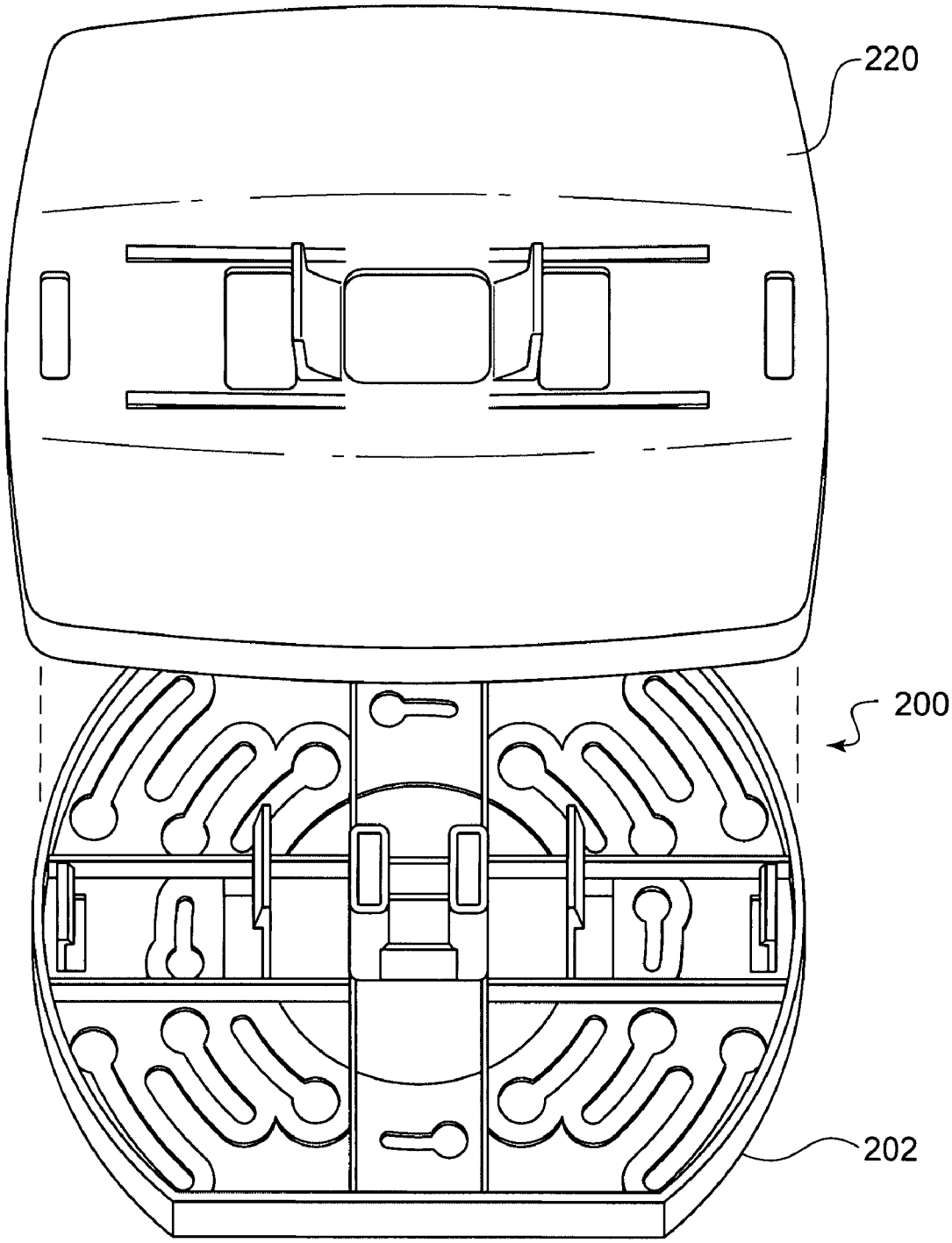
FIG. 8 shows a perspective view of the canopy element of FIG. 7 being positioned over the mounting plate of FIG. 6.
Figure 9:
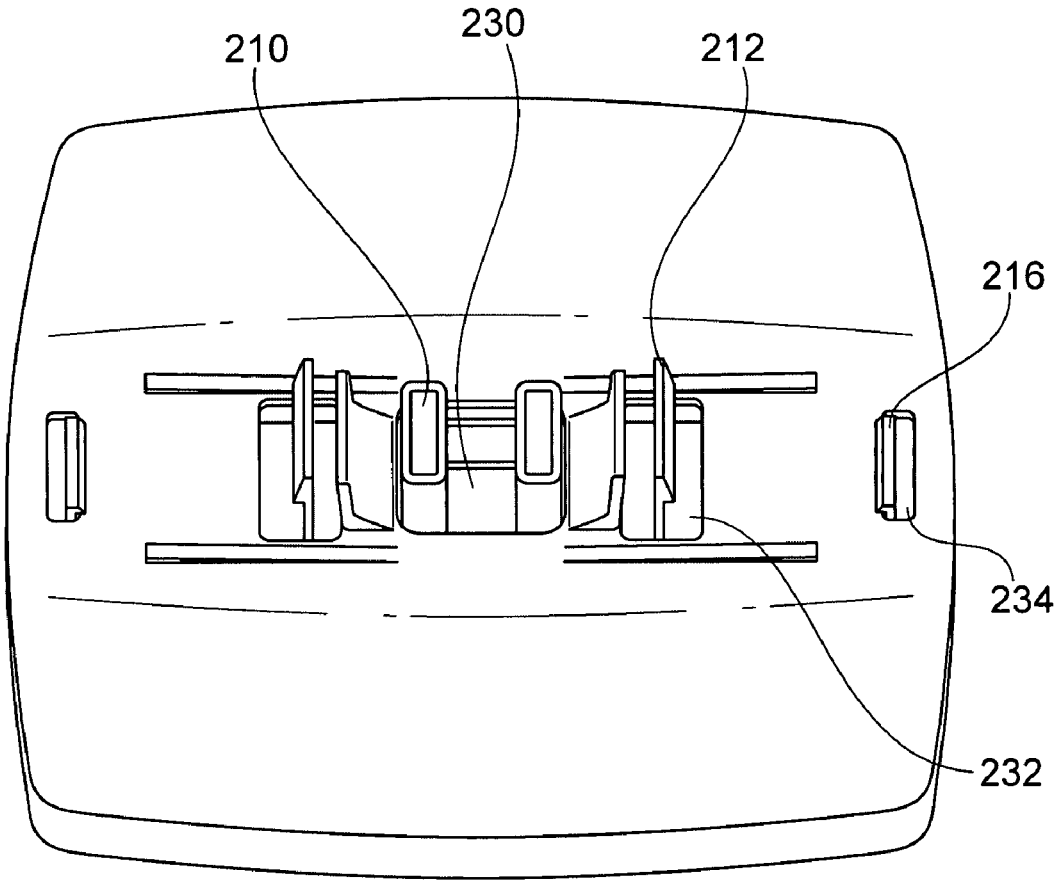
FIG. 9 shows a top perspective view of the mounting plate and canopy combination of FIG. 8, collectively referred to as a mounting device.

FIGS. 6-14 illustrate one embodiment of a mounting device 200 according to one aspect of this invention. Although these parts will be described in more detail below, in general, an assembled mounting device 200 connects to and mounts an illuminated sign to a junction box (not shown) that is mounted in or on a ceiling, wall, or the like. Mounting device 200 is comprised of a mounting plate 202 (shown in FIG. 6), a canopy element 220 (shown in FIG. 7), and a locking clip 240 (shown in FIG. 13). During use, the mounting plate 202 is mounted to a junction box, and the canopy 220 is placed over mounting plate 202, as shown in FIGS. 8 and 9. Once mounting device 200 is secured in an opening of a sign or a sign/sign insert, the locking clip 240 is positioned to secure the plate 202 and canopy 220 to one another, as well as to the sign or sign/sign insert combination. While the mounting device 200 may be used with any type of mountable sign, for purposes of illustration and discussion, it is described for use with emergency exit signs.

More specifically, FIG. 6 shows a mounting plate 202. Mounting plate has a series of openings 204 that can be used to receive securing elements (such as screws) to secure plate 202 to a junction box. In the embodiment shown, the openings 204 are patterned to correspond to the apertures in junction boxes of various configurations. This allows the mounting plate 202 to be universally mounted to a variety of junction boxes. Openings 204 may also include at least one junction box mounting aperture (for mounting the mounting plate 202 onto a junction box).

Mounting plate has a mounting base 206, which is positioned adjacent a junction box mounted in a wall or ceiling during installation. Electrical wiring may be fed from the junction box through the openings 210. Mounting plate 202 is then fixed to the junction box via a fastener, such as a screw, nail, tack, etc. (Typically, J-box screws are provided with the product to enforce the National Electrical Code's requirement of screws-only.) The fastener is positioned to extend through at least one of the openings 202, as well as a corresponding aperture in the junction box.

Upper surface 208 of mounting plate features elements that are used to secure the plate 202 to a canopy 220 and a sign or a sign/sign insert combination. In the embodiment shown, upper surface 208 has at least one positioning element 210, at least one lip element 212 having a lip 214, and at least one tab 216. The way that these elements cooperate with the canopy 220 will be described further below. Although not shown, it is also possible for there to be an aperture or opening at or near the positioning elements 210, which can serve as a passageway through which wiring from the junction box may pass.

Mounting plate 202 may be made from any material having suitable properties, such as rigidity suitable to withstand the weight of a suspended sign and elasticity to enable a snap-fit connection between structures on the mounting plate 202 and the sign or sign/sign insert combination. Mounting plate 202 is preferably formed from a thermoplastic material and more preferably from an engineering grade thermoplastic, such as polycarbonate, glass-filled polycarbonate, nylon, glass-filled nylon, polyester, glass-filled polyester, and most preferably from glass-filled polycarbonate. It may be molded, and is preferably injection-molded.

FIG. 7 shows an embodiment of a canopy element 220 that is adapted to be positioned over the mounting plate 202, as shown in FIGS. 8 and 9. Canopy element 220 may be any size and/or shape but should be dimensioned so that, when positioned over the mounting plate 202, the underlying junction box and mounting plate 202 are covered by the canopy element 220.

Referring back to FIG. 7, canopy element 220 has sides 222 that form a canopy cavity 224, which is the portion that receives the mounting plate 202. Upper surface 226 of canopy element 220 has at least one upstanding stabilizing elements 228 that extends upwardly from the upper surface 226 of canopy element 220, a central opening 230 between the elements, side openings 232 on either side of elements, and at least one tab receiving aperture 234.

Canopy element 220 may be formed from any suitably rigid material, including polymeric or metallic materials. If formed from a polymeric material, such material is preferably a thermoset and is preferably injection-molded or compression-molded and more preferably compression-molded. However, the canopy element 220 is preferably formed of a metal and more preferably from aluminum, zinc, or magnesium. The canopy element 220 may be formed via die-casting, sand-casting, machining, or permanent molding.

As shown in FIGS. 8 and 9, when canopy element 220 is properly positioned over the mounting plate 202, the positioning elements 210 of the plate 202 are received by the central opening 230 of the canopy 220, and the lip elements 212 of the plate 202 are received by the side openings 232 of the canopy 220. Additionally, the tabs 216 of the plate 202 are received by the tab receiving apertures 234 of the canopy 220. This allows the positioning elements 210 and the lip elements 212 to be securely received by, and secured with respect to the central 230 and side openings 232 of the canopy 220 and thereby prevent relative movement between the mounting plate 202 and the canopy element 220. The tabs 216 provide an intermediate capture of the canopy during installation, then provide support to prevent sagging. The tabs 216 may provide a mechanical stop to prevent the sign 10 from sagging in a side-mounted installation, and may help prevent uneven hanging in top-mounting.

Figure 10:
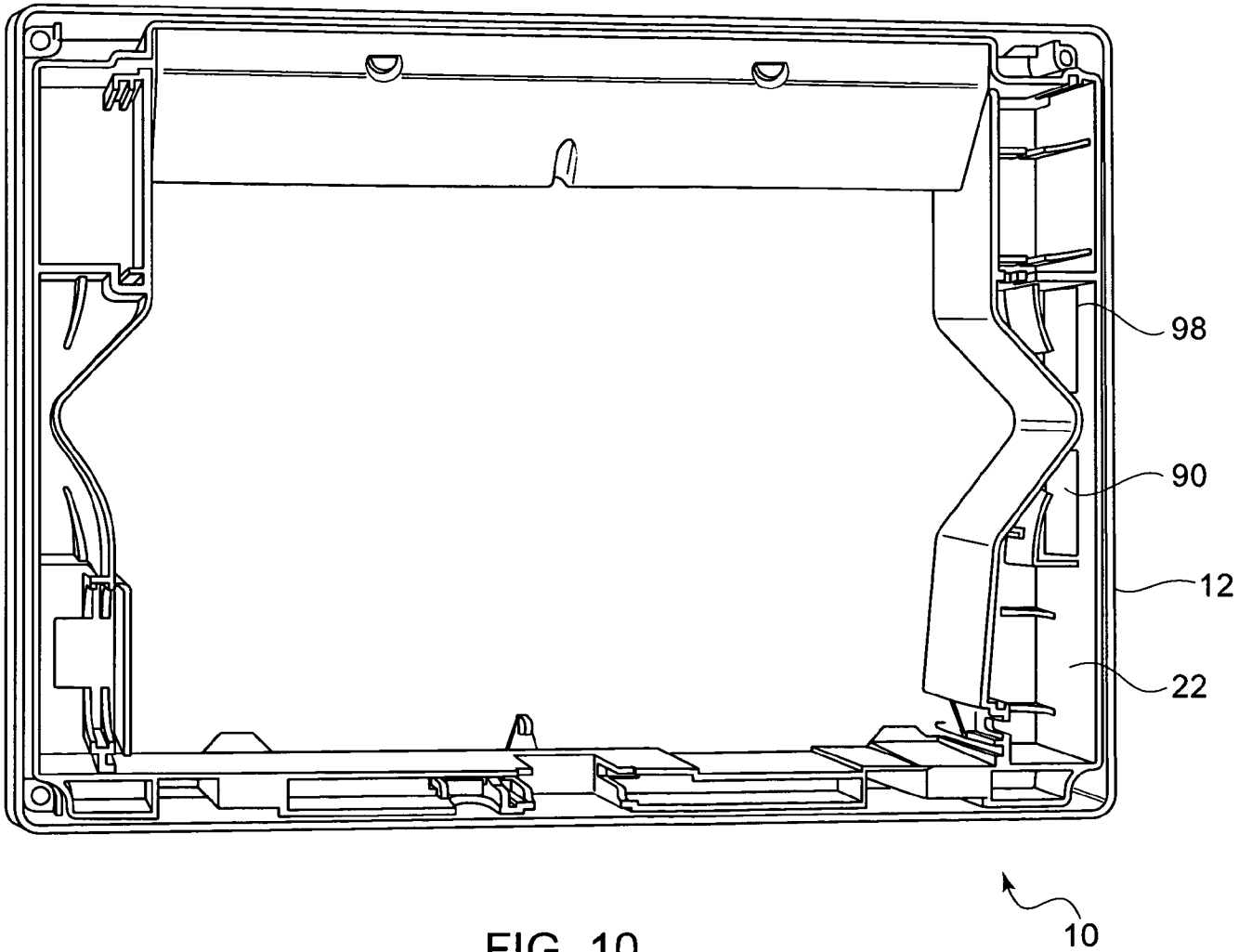
FIG. 10 shows a perspective view of one embodiment of a sign and sign insert combination.

Next, as shown in FIG. 10, a sign 10 (or a sign/sign insert combination, both options of which will be collectively referred to as a "sign" for ease of reference) may be provided. The sign 10 can be installed in a variety of ways, but the some common ways are top-mounted to suspend from a ceiling or side-mounted to project from a wall. Other options are back-mounting (where no canopy is used), end-mounting, or recessed mounting. At least one sign mounting opening 90 should be provided in the sign housing 12, and if a sign insert 22 is used, at least one insert mounting aperture 98 should also be provided on the insert 22.

Figure 11:
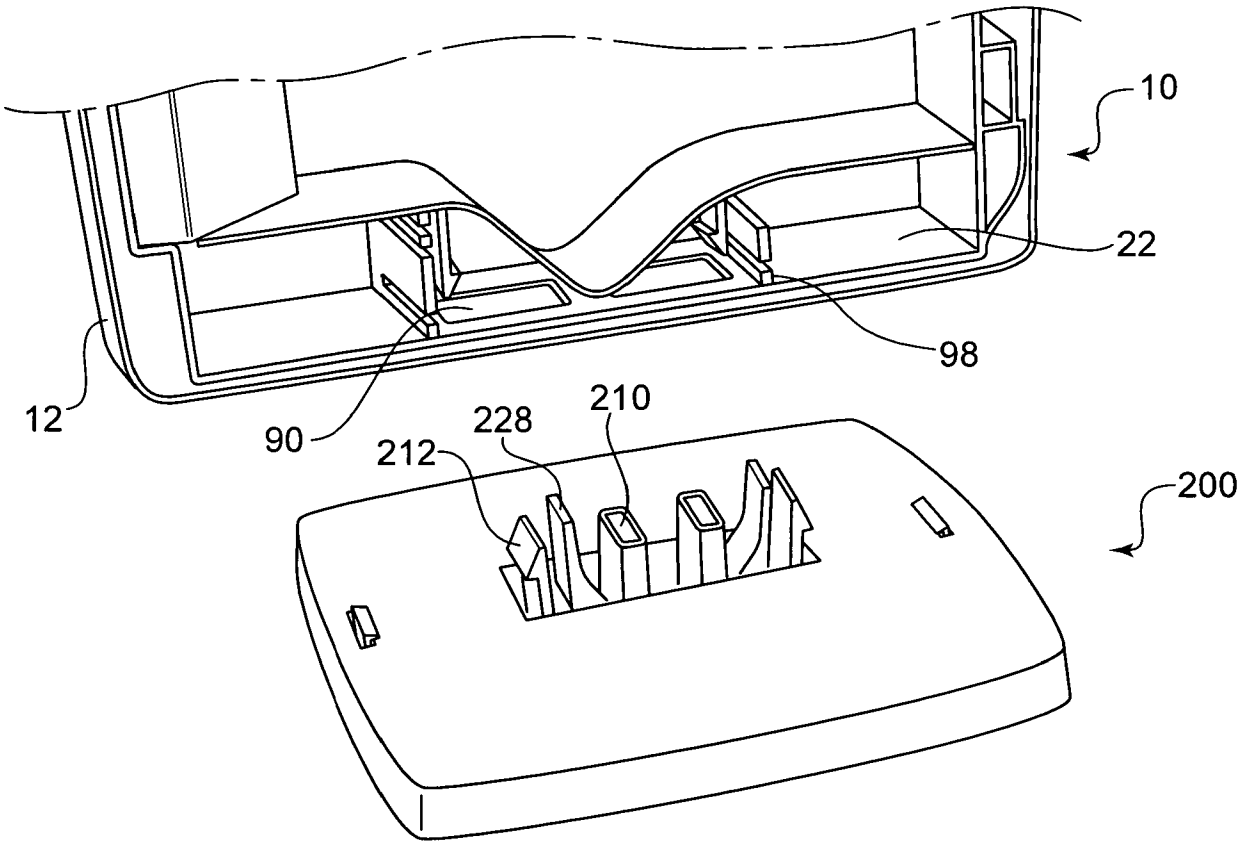
FIG. 11 shows a perspective view of the mounting device of FIG. 9 being positioned with respect to the sign and sign insert combination of FIG. 10.

As shown in FIG. 11, after positioning canopy element 220 over the mounting plate 202, a sign can be mounted on the mounting device 200. These openings/apertures 90, 98 in sign housing 12 and sign insert 22, respectively, are provided to receive the positioning elements 210, upstanding stabilizing elements 228, and lip elements 212 of the plate/canopy combination. As previously discussed, the openings/apertures may be provided at the desired mounting location, and are often provided in multiples (e.g., on the top/bottom and sides of the sign). A plurality of sign mounting openings 90 or apertures 98 can be provided in the sign housing 12 or sign insert 22 to achieve flexibility during installation. The installer can use the appropriate opening/aperture given the intended location of a sign, and the remaining sign mounting openings can be covered by plugs 92, as further discussed below. In this way, a universal exit sign can be manufactured to accommodate a plurality of available installation locations in the field. Moreover, an installed sign can be re-installed at a different mounting location on the sign by removing plug 92 and re-positioning the sign.

Figure 12:
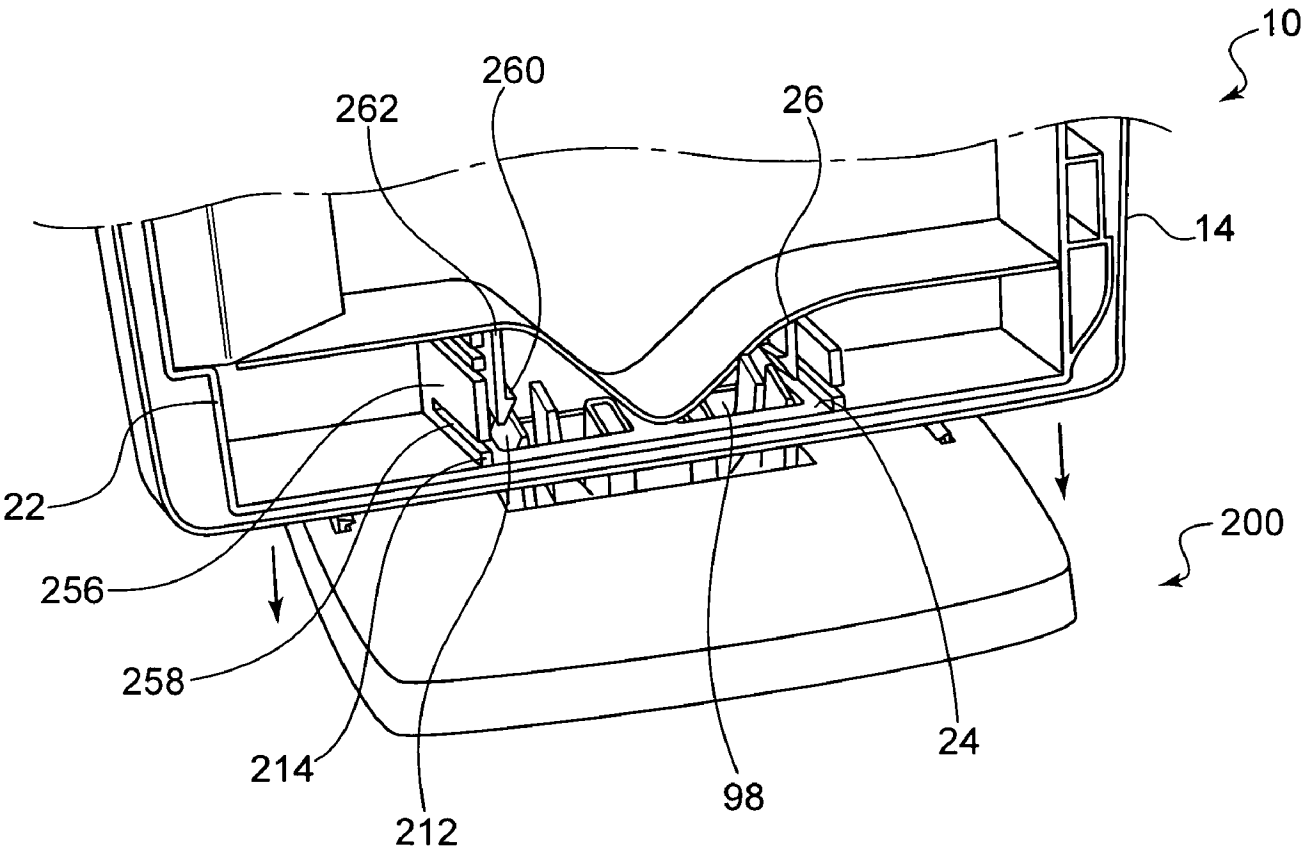
FIG. 12 shows a perspective view of the mounting device of FIG. 9 being engaged by the sign and sign insert combination of FIG. 10.

As shown in FIG. 12, during sign mounting, the wall of the housing frame 14 that surrounds the sign mounting opening 90 forces lip elements 212 to flex inwardly to allow their insertion through the sign mounting opening 90 (and/or the insert 22 mounting aperture 98). Once inside, the lip elements 212 snap outwardly and allow the lip 214 on the outside edge of lip elements 212 to engage the sign 10 and to provide a snap-fit connection between the sign 10 and the mounting device 200.

In certain embodiments, the sign or sign insert may be provided with a corresponding lip structure that receives and secures lip elements 212 in place. For example, the sign insert 22 shown in FIGS. 11, 12, and 14 has lip elements 260 that extend from an inner wall 262 of insert 22. In certain embodiments, lip elements 260 capture hole plugs, and lip elements 212 of the mounting plate engage the edges of the canopy openings in the housing.

Figure 13:
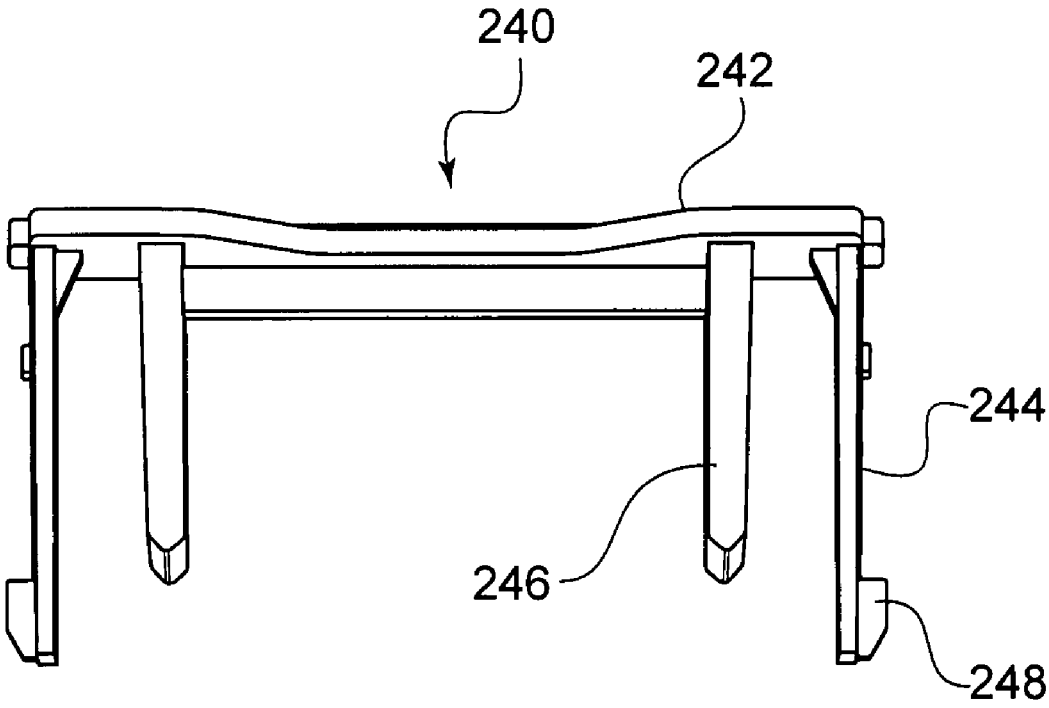
FIG. 13 shows a side perspective view of an embodiment of a locking clip.

Upon receipt of the portions of the mounting device 200 into the sign 10, the sign 10 is somewhat secured to the mounting device 200. However, the weight of a heavy sign could potentially cause lip elements 212 to lose their tight fit, so mounting device 200 can be secured further in a plurality of ways. In a specific embodiment, a locking clip 240 is used. An example of a locking clip 240 is shown in FIG. 13. The locking clip shown has a flat top portion 242, outer legs 244, and inner legs 246. The outer legs 244 may have optional lips 248 on their outer surfaces.

Figure 14:
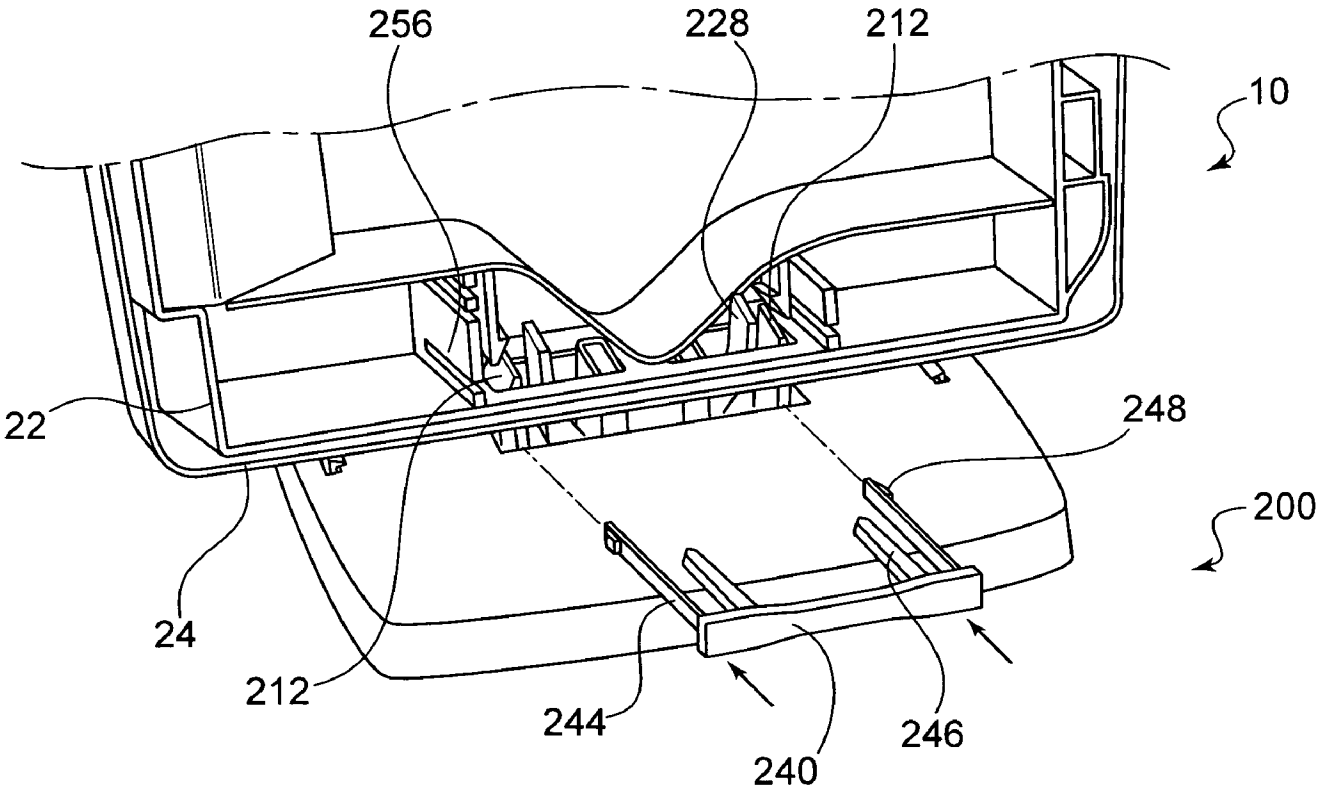
FIG. 14 shows the insertion of the locking clip of FIG. 13 with respect to the mounting device and the sign and sign insert combination of FIG. 12.

As shown in FIG. 14, once sign 10 is secured with respect to mounting device 200 locking clip 240 is inserted on the inner side of sign. In a particularly preferred embodiment, the sign 10 has a sign insert 22 positioned therein. As shown in FIG. 12, insert 22 has an aperture 98 in its outer wall 24 and at least one receiving lip element 260 extending from its inner wall 26. Insert 22 also has at least one side wall 256 having guide tracks 258. The guide tracks 258 are shown as formed along at least a portion of side walls 256.

Referring now to FIG. 14, the locking clip 240 is adapted to engage structure on the outer wall 24 of insert 22, such that its outer legs 244 are positioned adjacent to the side walls 256 and the lip elements 212 of mounting plate 202. (When locking clip 240 is positioned, tabs 248 on the outer legs 244 engage and slide in guide tracks 258 of insert 22.) The inner legs 246 of clip 240 are positioned between the lip elements 212 of the mounting plate 202 and the upstanding stabilizing elements 228 of canopy element 220. In this way, the inner legs 246 bias outwardly to ensure that they cannot and do not flex inwardly to disengage from the sign.

Figure 15:
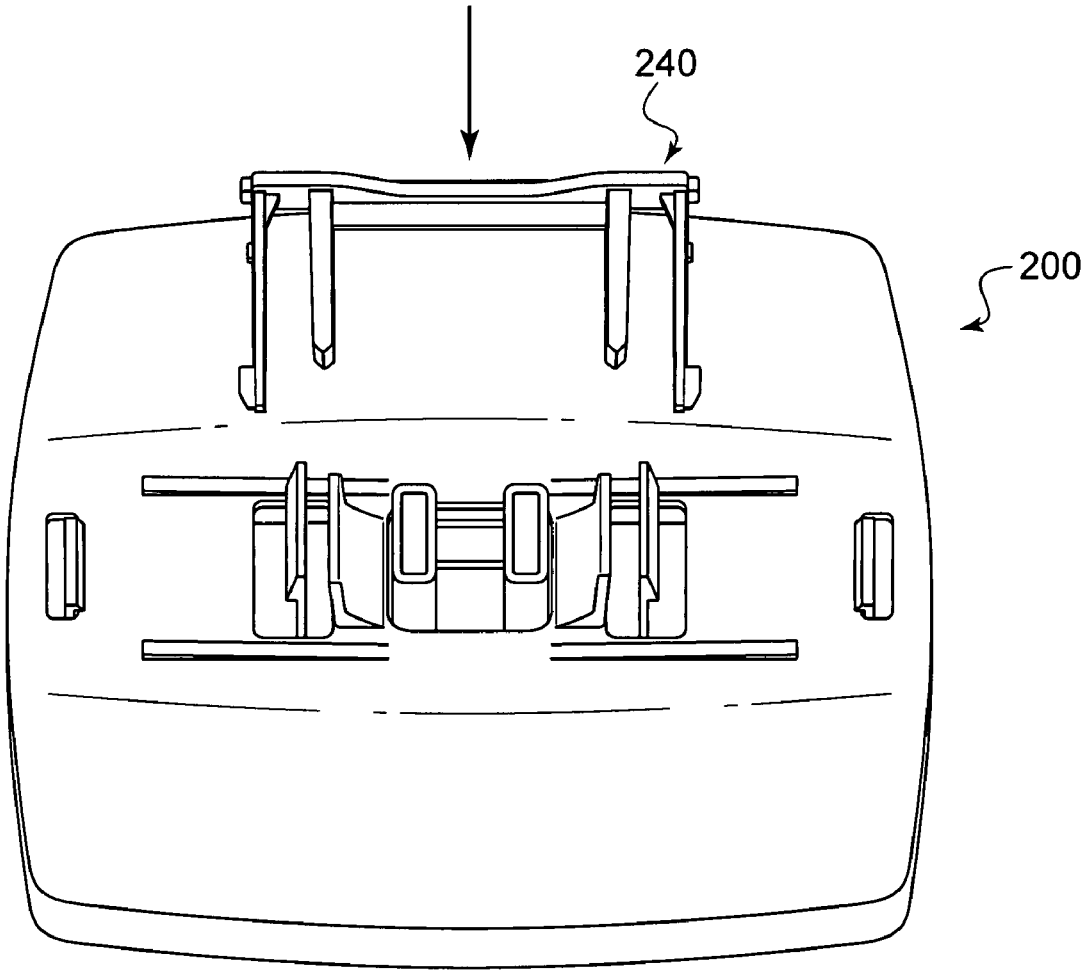
FIG. 15 shows a perspective view of the locking clip of FIG. 13 and its interaction with a mounting device of FIG. 9.

FIG. 15 shows an example that may be used if the sign 10 is not used with an insert 22. In this instance, the structures that protrude from the mounting device are received by an opening 90 in the sign housing 12, and a locking clip interfaces directly with the above-described structures to secure the sign to the mounting device 200.

Figure 17A:
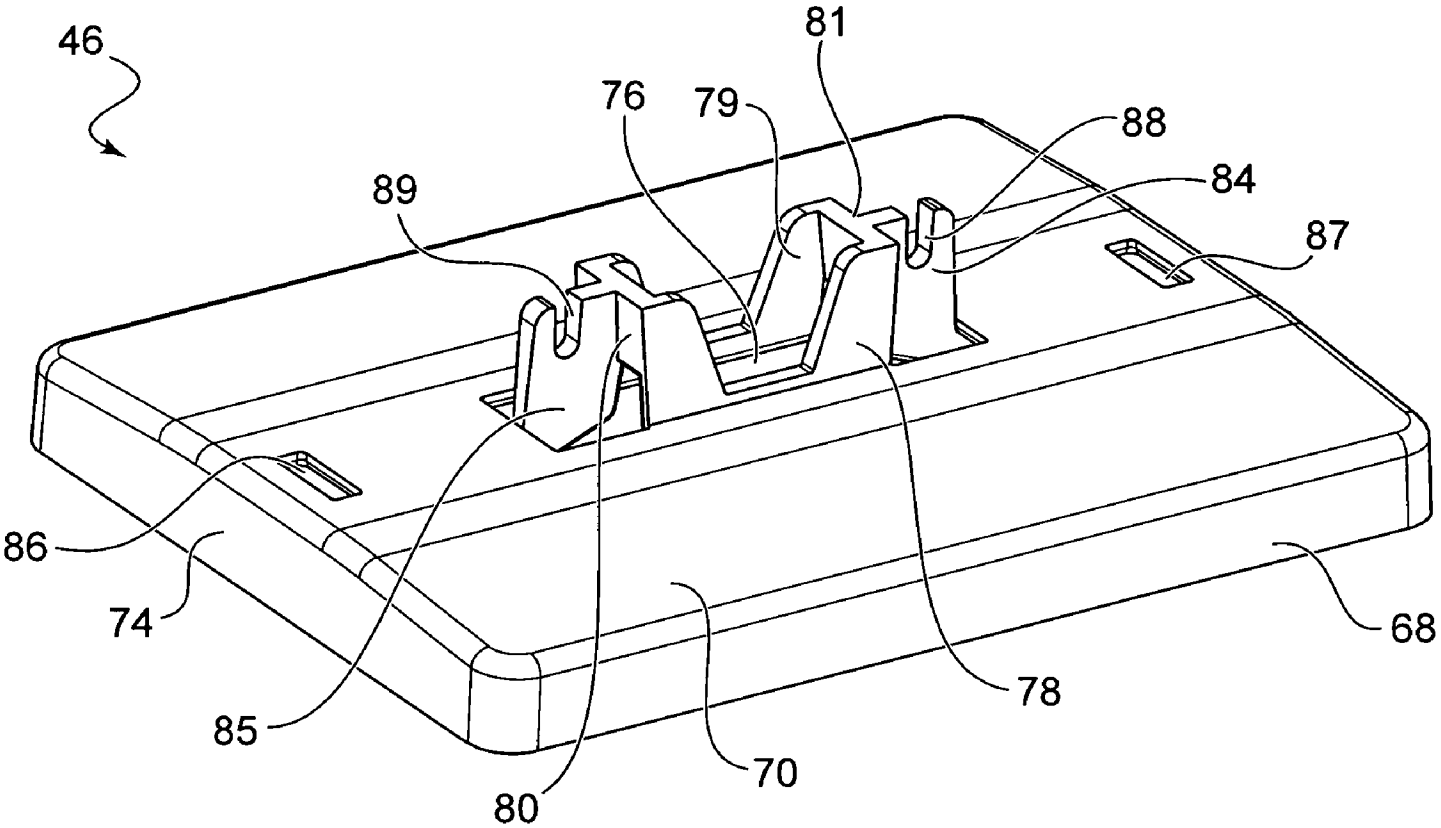
FIGS. 17A and 17B shows a top perspective and top plan views, respectively, of an alternate embodiment of a canopy element.
Figure 17B:
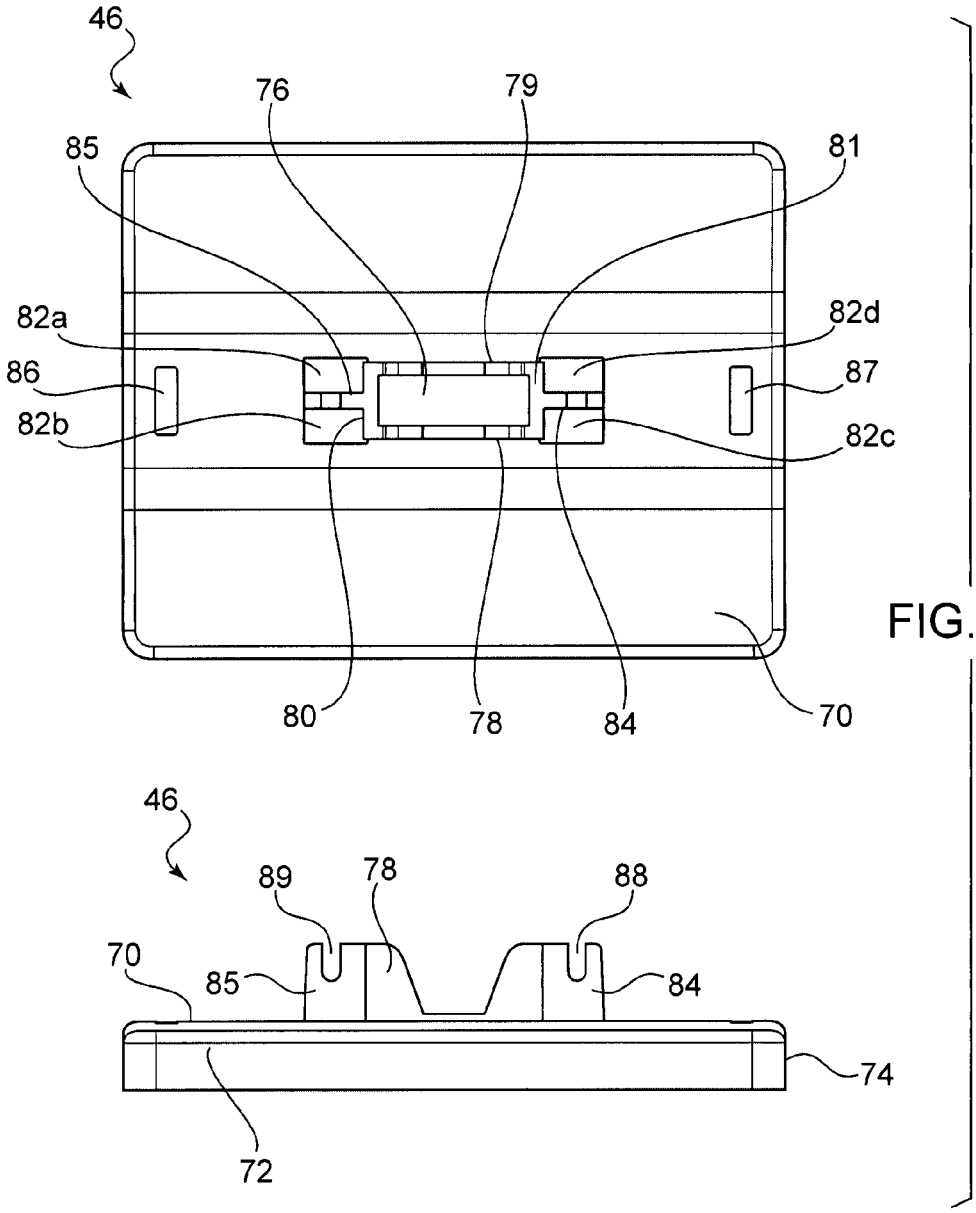
Figure 18:
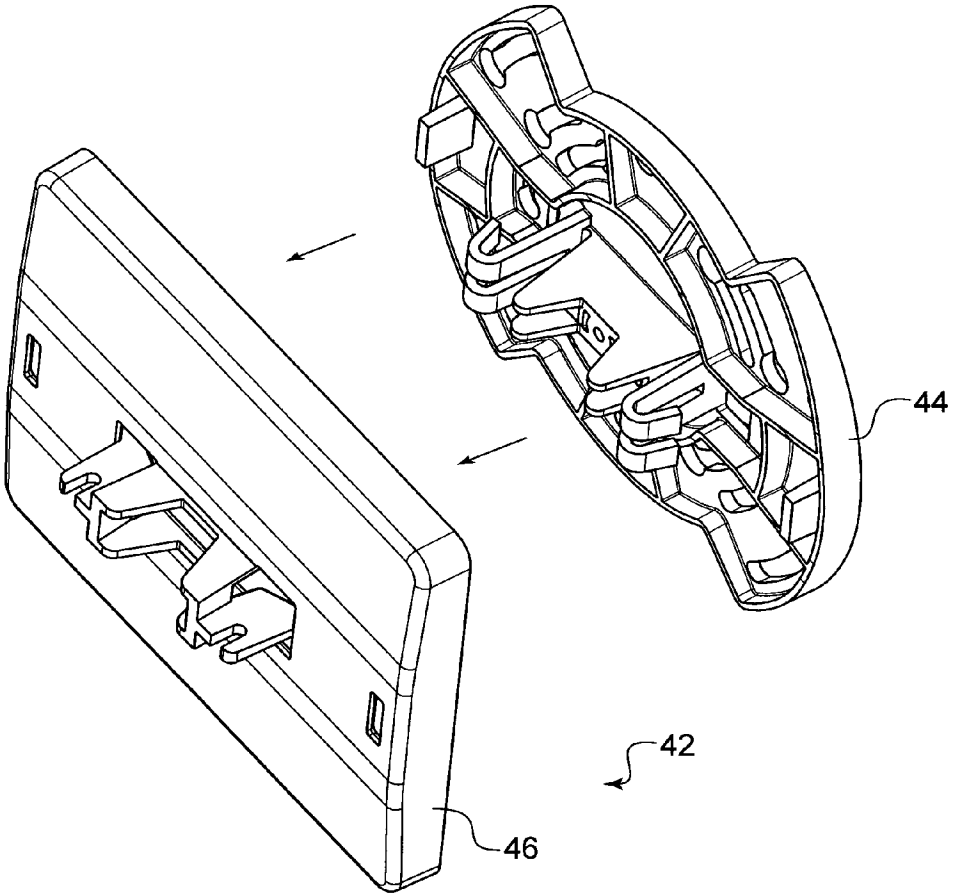
FIG. 18 shows an exploded perspective view of the canopy element of FIG. 17 being positioned over the mounting plate of FIG. 16 to form a mounting device.
Figure 19:
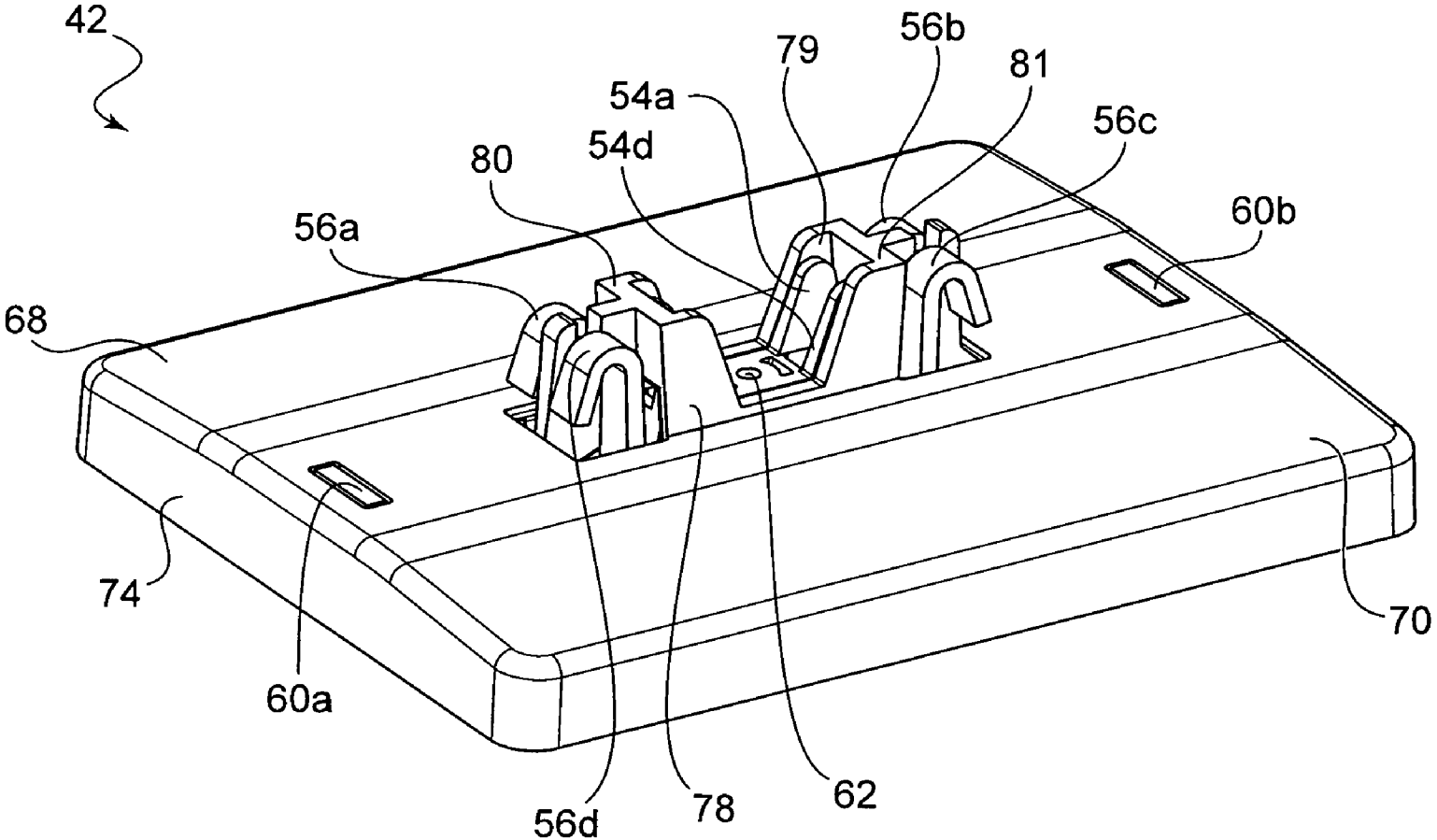
FIG. 19 shows a top perspective view of the assembled mounting device of FIG. 18.
Figure 20:
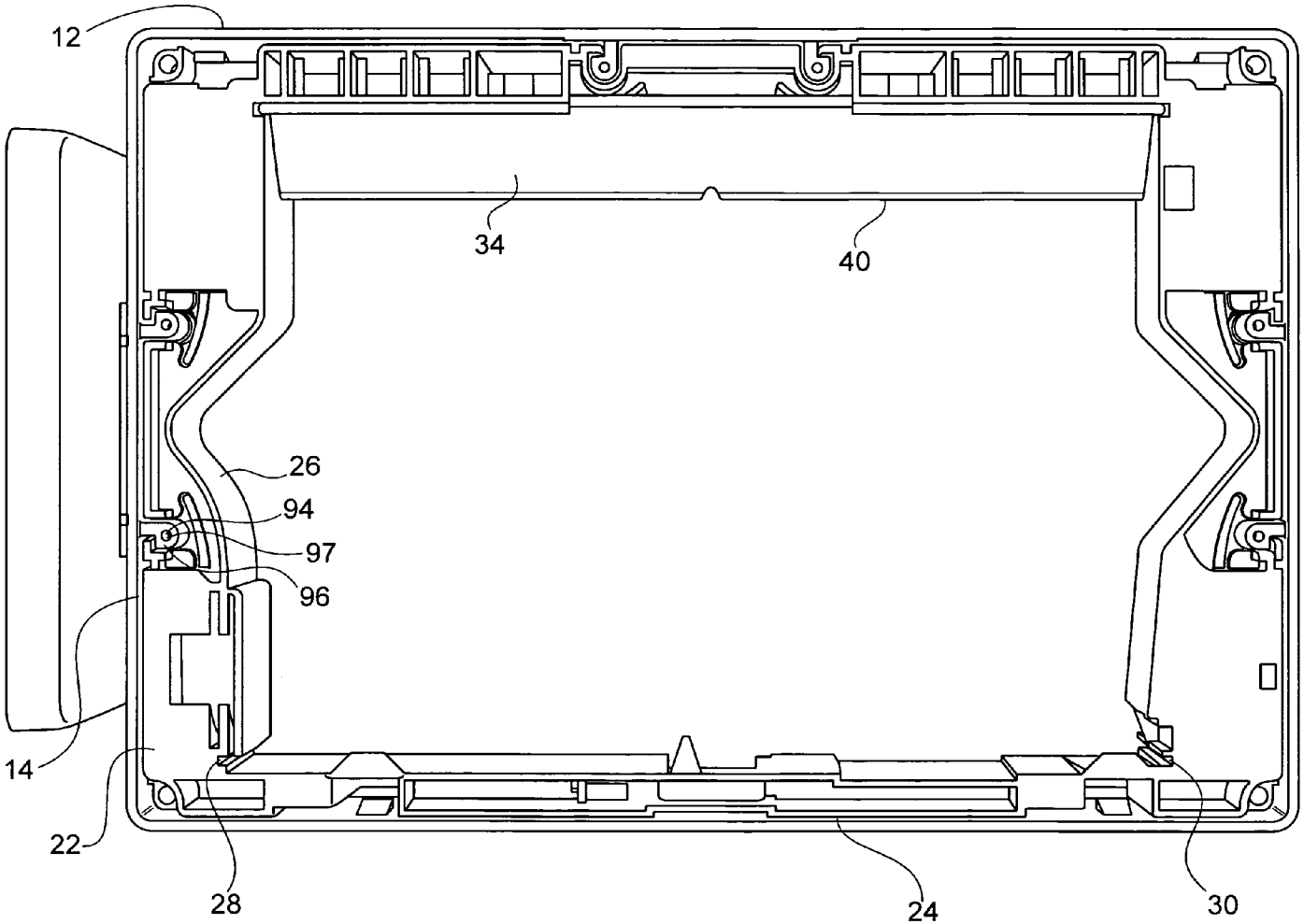
FIG. 20 shows a rear perspective view of the mounting device of FIG. 19 engaged with a sign and sign insert combination.

FIGS. 16-19 illustrate an alternate embodiment of a mounting device 42 according to another embodiment of this invention. The mounting device 42 connects to and mounts an exit sign to a junction box (not shown) that is mounted in or on a ceiling, wall, or the like. As shown in the blown-apart view of FIG. 18, the mounting device 42 includes a mounting plate 44, shown in more detail in FIG. 16, and a canopy element 46, shown in more detail in FIG. 17. The canopy element 46 is adapted to be positioned over the mounting plate 44. The completed assembly is shown in FIG. 19. While the mounting device 42 may be used with any type of mountable sign, for purposes of illustration and discussion, it is described for use with emergency exit signs.

The mounting plate 44 can be made from any material having suitable properties, such as rigidity suitable to withstand the weight of a suspended sign and elasticity to enable a snap-fit connection between structures on the mounting plate 44 and the sign 10. The mounting plate 44 is preferably formed from a thermoplastic material and more preferably from an engineering grade thermoplastic, such as polycarbonate, glass-filled polycarbonate, nylon, glass-filled nylon, polyester, glass-filled polyester, and most preferably from glass-filled polycarbonate. The mounting plate 44 is preferably molded and more preferably injection-molded.

Figure 16:
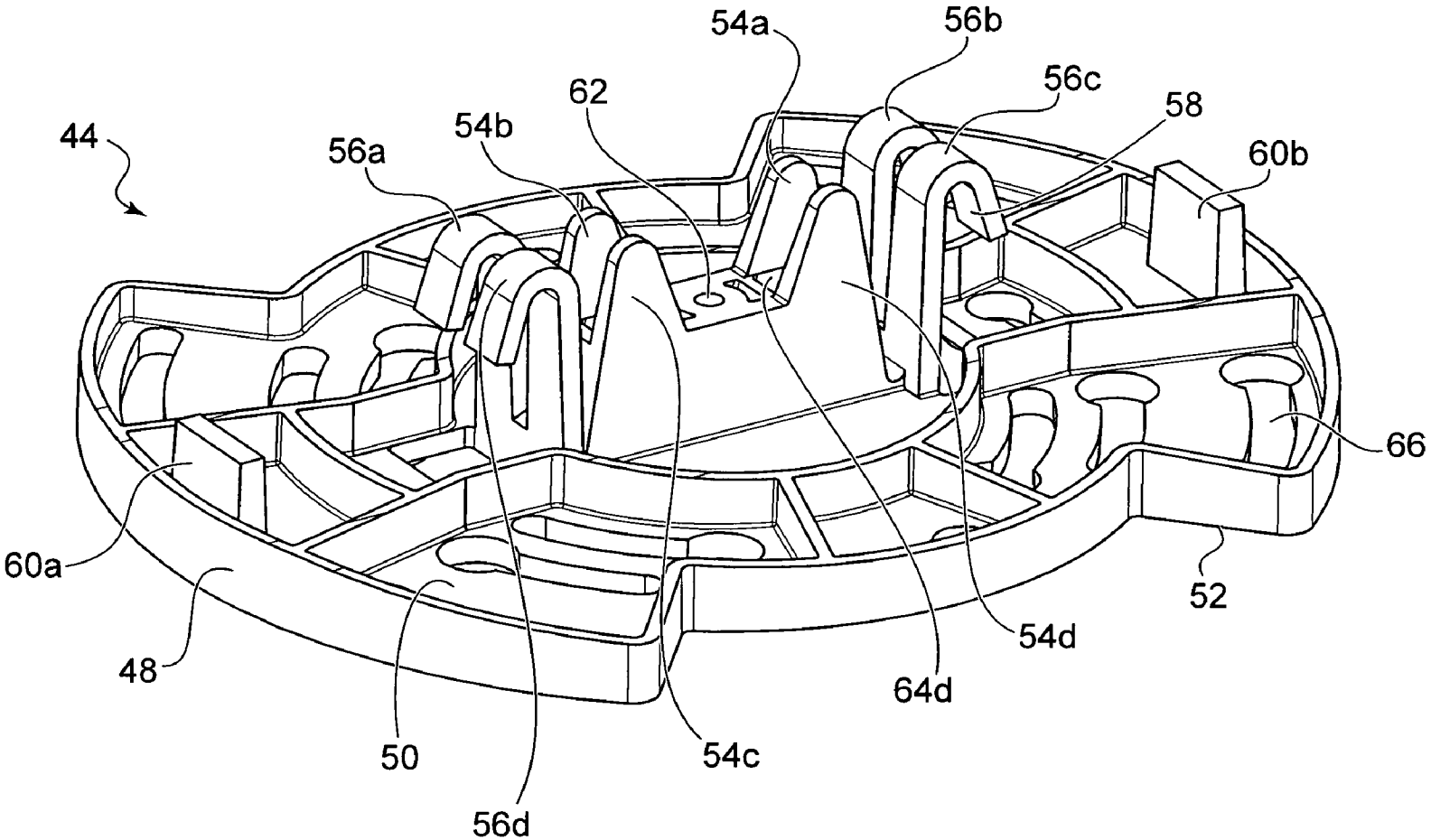
FIG. 16 shows a top perspective view of an alternate embodiment of a mounting plate.

The mounting plate 44 of FIG. 16 includes a mounting base 48 having an upper surface 50 and a lower surface 52. At least one positioning boss 54 (54*a-d* are shown), at least one hook 56 (56*a-d* are shown) each having a free end 58 extend from the upper surface 50 of the mounting plate 44. Also extending from the upper surface 50 of the mounting plate 44 will be at least one tab 60 (60*a* and 60*b* are shown). The mounting plate 44 may also have at least one mounting aperture. For example, it may have a central screw aperture 62 and/or at least one wire aperture 64 (64*a* and 64*b* are shown in FIG. 16) extend through the mounting plate 44. The mounting plate 44 may also include at least one junction box mounting aperture 66 for mounting the mounting plate 44 onto a junction box. However, more preferably, the mounting plate 44 includes a plurality of apertures patterned on the mounting plate to correspond to the apertures in junction boxes of various configurations. In this way, the mounting plate may be universally mounted on a variety of junction boxes.

During installation, the lower surface 52 of the mounting plate 44 is positioned adjacent a junction box mounted in a wall or ceiling (not shown). Electrical wiring (not shown) is fed from the junction box through that at least one wire aperture 64 of the mounting plate 44. The mounting plate 44 is fixed to the junction box via a fastener, such as a screw, nail, tack, etc. (although screws are often required by regulatory agencies). The fastener is positioned to extend through at least one of the plurality of junction box mounting apertures 66 in the mounting plate 44 and a corresponding aperture in the junction box. In this way, the at least one fastener connects the junction box and the mounting plate 44.

A canopy element 46 as shown in FIG. 17 is then positioned over the mounting plate 44, as shown in FIG. 18. The canopy element 46 may be formed from any suitably rigid material, including polymeric or metallic materials. If formed from a polymeric material, such material is preferably a thermoset and is preferably injection-molded or compression-molded and more preferably compression-molded. However, the canopy element 46 is preferably formed of a metal and more preferably from aluminum, zinc, or magnesium. The canopy element 46 is preferably, but does not have to be, formed via die-casting, sand-casting, machining, or permanent molding, and most preferably via die-casting.

The canopy element 46 may be any size and/or shape but should be dimensioned so that, when positioned over the mounting plate 44, the underlying junction box and mounting plate 44 are fully covered by the canopy element 46.

The canopy element 46 includes a canopy base 68 having an upper surface 70, a lower surface 72, and side walls 74. The canopy base 68 is preferably u-shaped to define a cavity in its underside capable of receiving the mounting plate 44 when the canopy element 46 is positioned over the mounting plate 44. The canopy element 46 includes at least one positioning boss aperture 76 defined by upstanding positioning walls 78, 79, 80, 81 extending upwardly from the upper surface 70 of the canopy element 46, at least one hook aperture 82*a-d* (shown in FIG. 17B) at least partially defined by upstanding side walls 84, 85 that extend outwardly from positioning walls 80, 81 respectively, and at least one tab aperture 86, 87. Slots 88, 89 may also be provided in side walls 84, 85, respectively.

When the canopy element 46 is properly positioned over the mounting plate 44, as shown in FIG. 19, the at least one positioning boss 54*a-d*, at least one hook 56*a-d*, and at least one tab 60*a*, 60*b* of the mounting plate 44 extend through the at least one positioning boss aperture 76, at least one hook aperture 82*a-d*, and at least one tab aperture 86, 87 of the canopy element 46, respectively. The positioning walls 78, 79, 80, and 81 defining the positioning boss aperture 76 at least partially surround the positioning bosses 54*a-d* and thereby prevent relative movement between the mounting plate 44 and the canopy element 46. Moreover, the positioning boss aperture 76 allows the electrical wiring from the junction box to pass through the canopy element 46 for connection with and to provide internal power to the exit sign, concepts that are well understood by those skilled in the art. In this way, the wiring may easily be pulled from junction box into the interior of the exit sign.

After positioning canopy element 46 over the mounting plate 44, the exit sign 10 can be mounted on the mounting device 42. The exit sign 10 can be installed in a variety of ways, which are described above. Common ways are top-mounted to suspend from a ceiling or side-mounted to project from a wall, examples of which are shown in FIGS. 4 and 20-24. At least one sign mounting opening 90 (see FIG. 2) should be provided in the sign housing 12 (preferably in the housing frame 14) to allow mounting of the sign 10 at the desired mounting location (whether that be on the top, side(s), bottom, or corners of the sign). A plurality of sign mounting openings 90 may be provided in the sign housing 12 to achieve flexibility during installation. The installer can use the appropriate sign mounting opening 90 given the intended location of a sign, and the remaining sign mounting openings can be covered by plugs 92, as further discussed below. In this way, a universal exit sign can be manufactured to accommodate a plurality of available installation locations in the field. Moreover, an installed sign can be re-installed at a different mounting location on the sign via removal of a plug 92 from a sign mounting opening 90.

The sign mounting openings 90 in the sign 10 are configured to receive portions of a mounting device, for example, the mounting device 42, as shown in FIG. 4. In particular, the structures extending from the upper surface 70 of the canopy element 46 (i.e., positioning walls 78-81 and side walls 84, 85) and from the upper surface 50 of the mounting plate 44 (i.e., positioning bosses 54*a-d* and hooks 56*a-d*) enter the sign housing 12 (see FIG. 4). During sign mounting, the wall of the housing frame 14 that surrounds the sign mounting opening 90 forces the hooks 56*a-d* to flex inwardly to allow their insertion through the sign mounting opening 90. Once inside, the hooks 56*a-d* snap outwardly to resume their equilibrium position. The free ends 58 of the hooks 56*a-d* engage the edges of the canopy opening of the housing.

Figure 21:
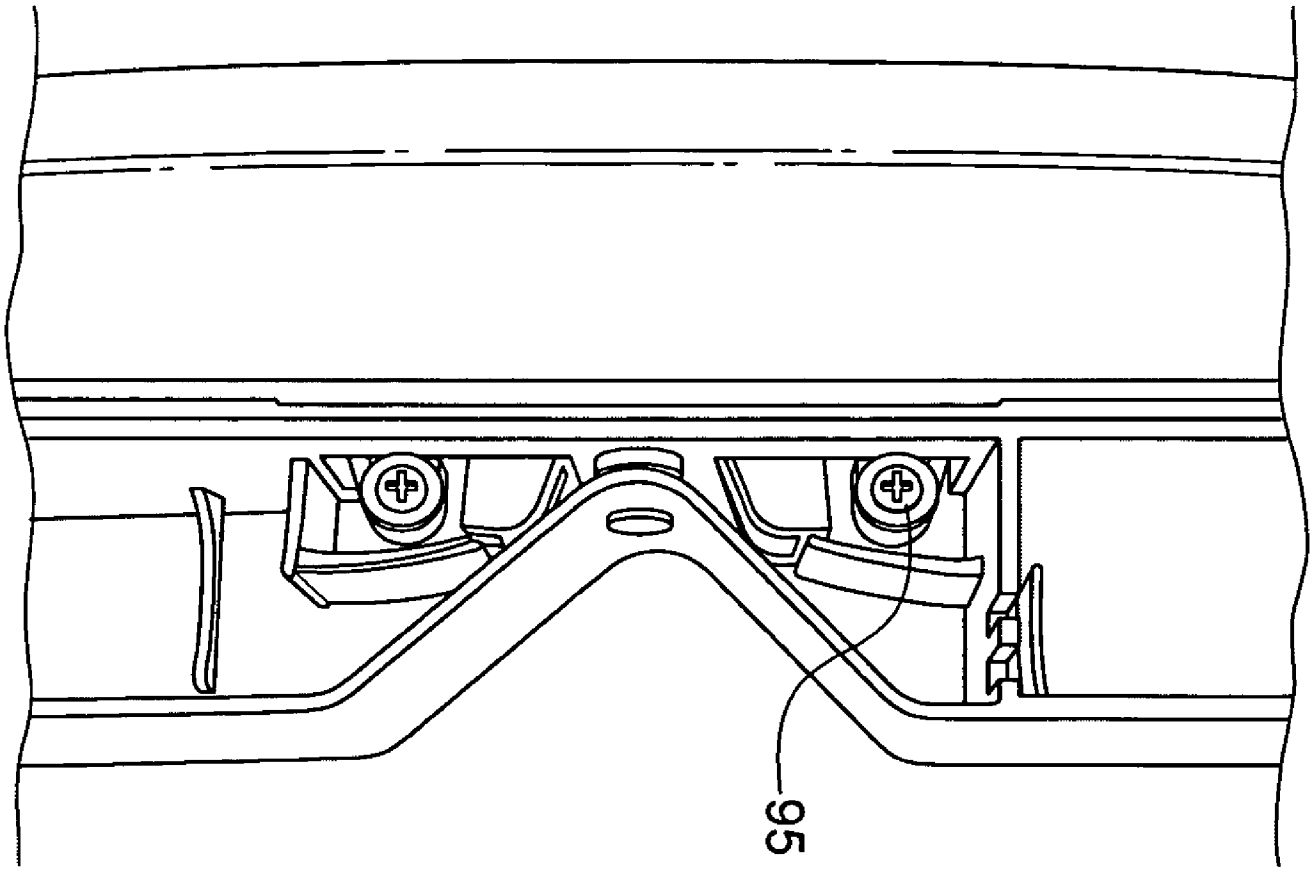
FIGS. 21-24 show perspective views of the sign and sign insert combination mounted with the mounting device of FIG. 19 in various top and side mounted installations.
Figure 22:
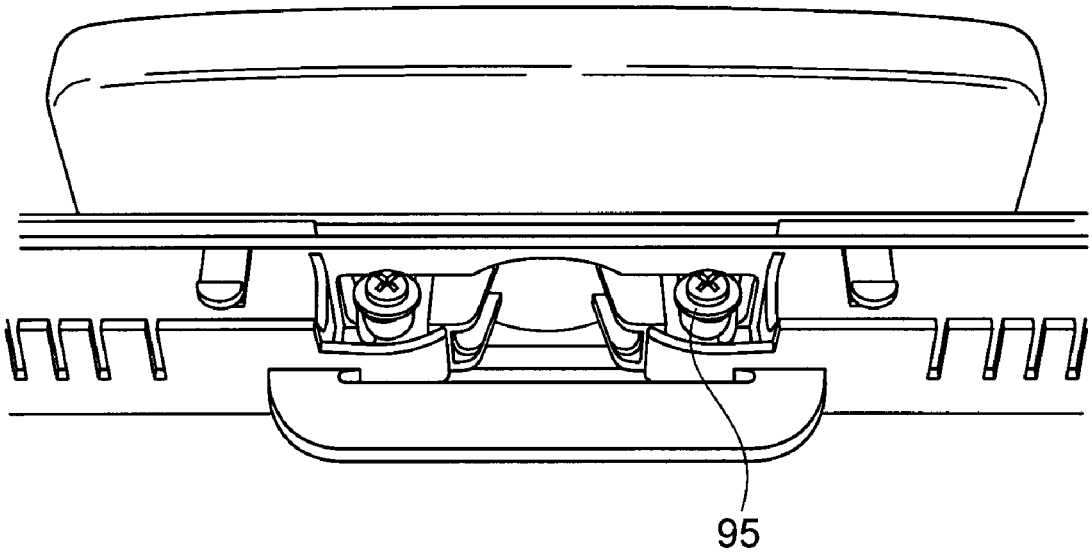

Upon receipt of the portions of the mounting device 42 into the sign 10, the sign 10 can be secured further to the mounting device 42 in a plurality of ways. When the canopy element 46 is positioned over the mounting plate 44, the slots 88, 89 in the side walls 84, 85 of the canopy element 46 align with the underside of the hooks 56 of the mounting plate 44 to form a fastener receptacle 94 (see FIG. 4) for receiving a fastener. In an alternate embodiment, shown in FIG. 20, a boss 96 having an aperture 97 may be provided on the housing frame 14 so that the aperture 97 aligns with a fastener receptacle 94. As shown in FIGS. 21 and 22, a screw or other suitable fastener 95 may be inserted into the receptacle 94 and secured in boss 96 to reinforce and provide additional stability to the sign during mounting.

Figure 23:
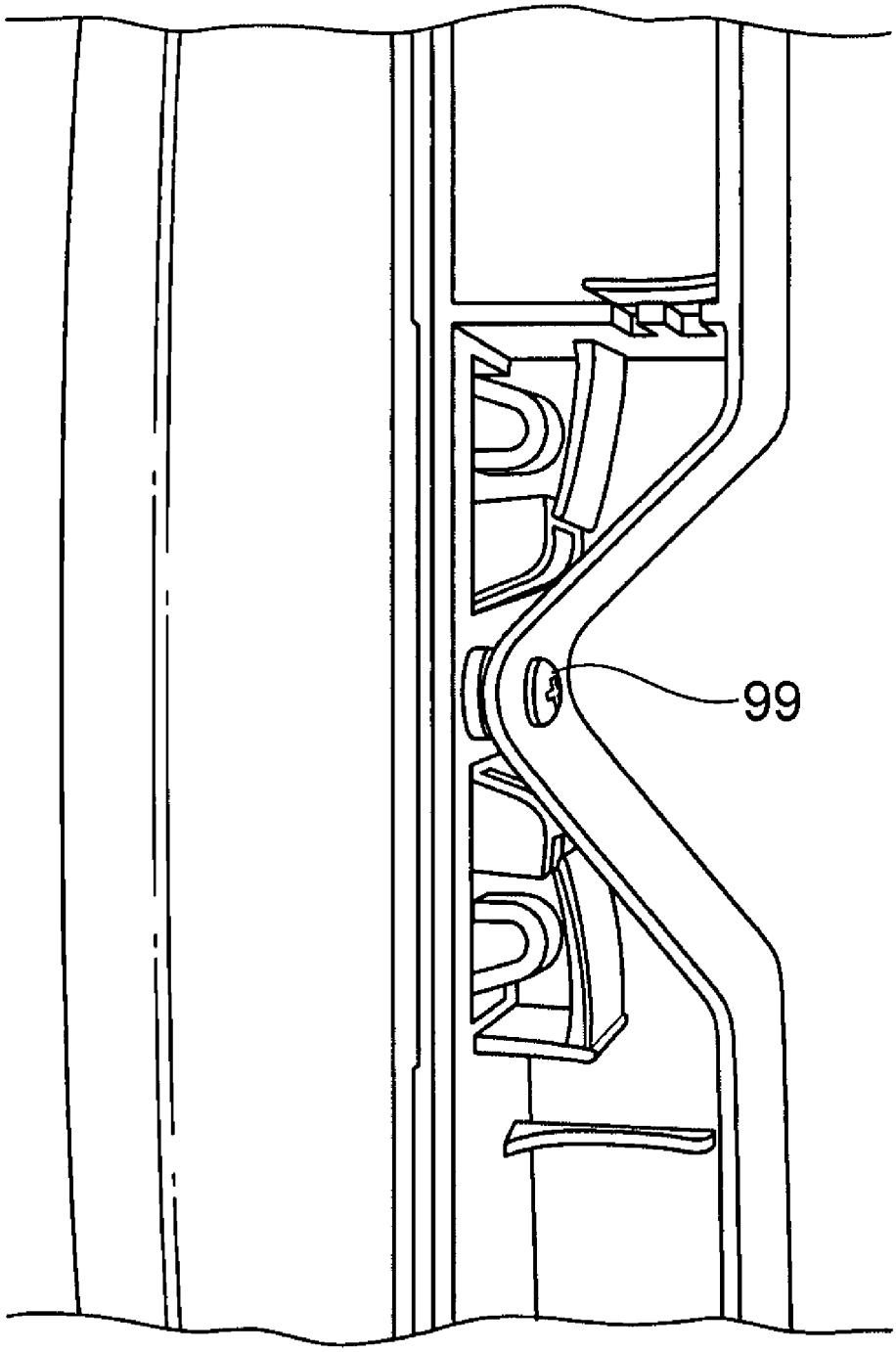
Figure 24:
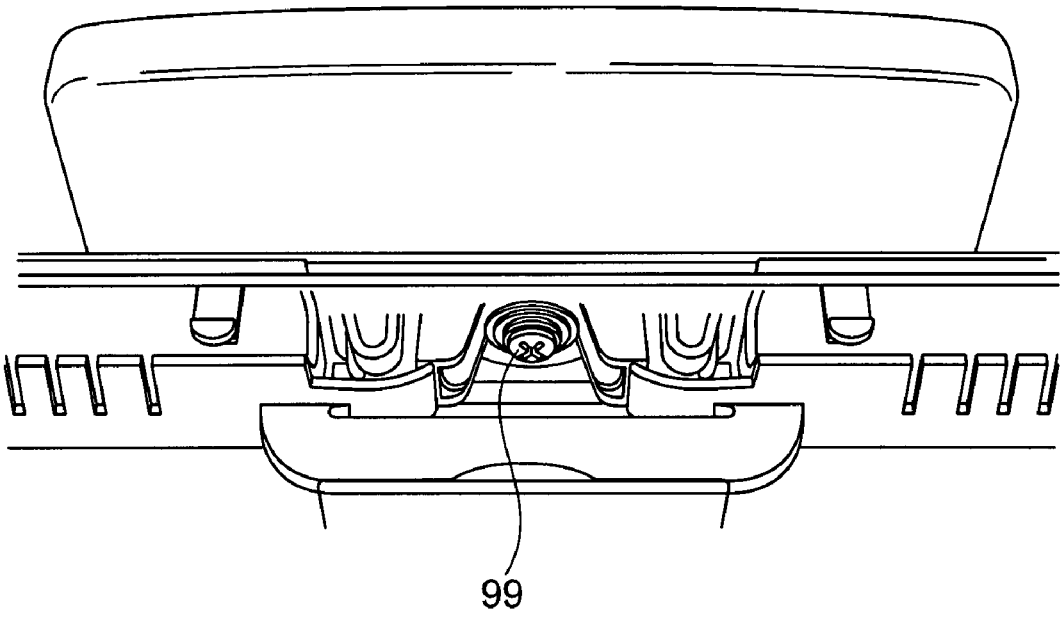

Although not required, the sign 10 is preferably equipped with an insert 22, which includes insert mounting device portions 25, which may be mounting apertures 98 (see FIG. 2) that receive the portions of a mounting device 42 or 200. Insert mounting apertures 98 may be provided in a plurality of locations on the insert 22 to accommodate various sign mounting locations. For example, mounting apertures 98 may be provided on all four sides of insert, or they may be provided on only one of the side walls and one of the top or bottom walls. If the insert 22 is symmetrical, it can be flipped over (side-to-side or up-and-down) as appropriate. This can alleviate the need to provide more insert mounting apertures than needed. If an insert 22 is provided in the sign 10, the insert 22 can include an insert hole that aligns with the central screw aperture 62 in the mounting plate 44. As shown in FIGS. 23 and 24, a screw or other appropriate fastener 99 can then be secured in the sign insert hole and central screw aperture 62 to thereby further fix the sign 10 to the mounting device 42.

Moreover, the mounting device 42 and the insert 22 may include biasing structures that interact to bias mounting device (the canopy element in particular) towards the wall or ceiling. For example, FIG. 4 shows springs 102, 103 that are provided in, and preferably integrally-molded with, the insert 22. Upon insertion of portions of the mounting device 42 into the sign 10, the springs 102, 103 bear against, and exert an outward, and slightly downward pressure on, the tops of at least one of the (but preferably at least two of the) positioning walls 78-81 of the canopy element 46. In this way, the springs 102, 103 ensure that the canopy element 46 is biased towards the wall or ceiling and thereby covers the underlying junction box and mounting plate 44.

This biasing can take place even if the junction box is not installed flush with, but rather protrudes from or is recessed too far within, the wall or ceiling. In some embodiments, the mounting plate base 48 is thinner than the canopy element base 68. Thus, if the mounting plate base 48 is mounted on a junction box that protrudes from the wall, the cavity defined in the underside of the canopy element 46 is still deep enough to accommodate such a protrusion. Moreover, in this situation, the tabs 60*a*, 60*b* on the mounting plate 44 will extend through tab apertures 86, 87 of the canopy element 46 and, depending on the degree to which the junction box protrudes from the wall or ceiling, protrude from the upper surface 70 of the canopy element 46. Regardless of the biased location of the canopy toward the wall, tabs 60*a* and 60*b* protrude through apertures 86 and 87 to provide a mechanical stop against the housing and to prevent sagging in either mounting mode. The tabs 60*a*, 60*b* thereby provide a mechanical stop to prevent the sign 10 from sagging in a side-mounted installation.

Figure 25:
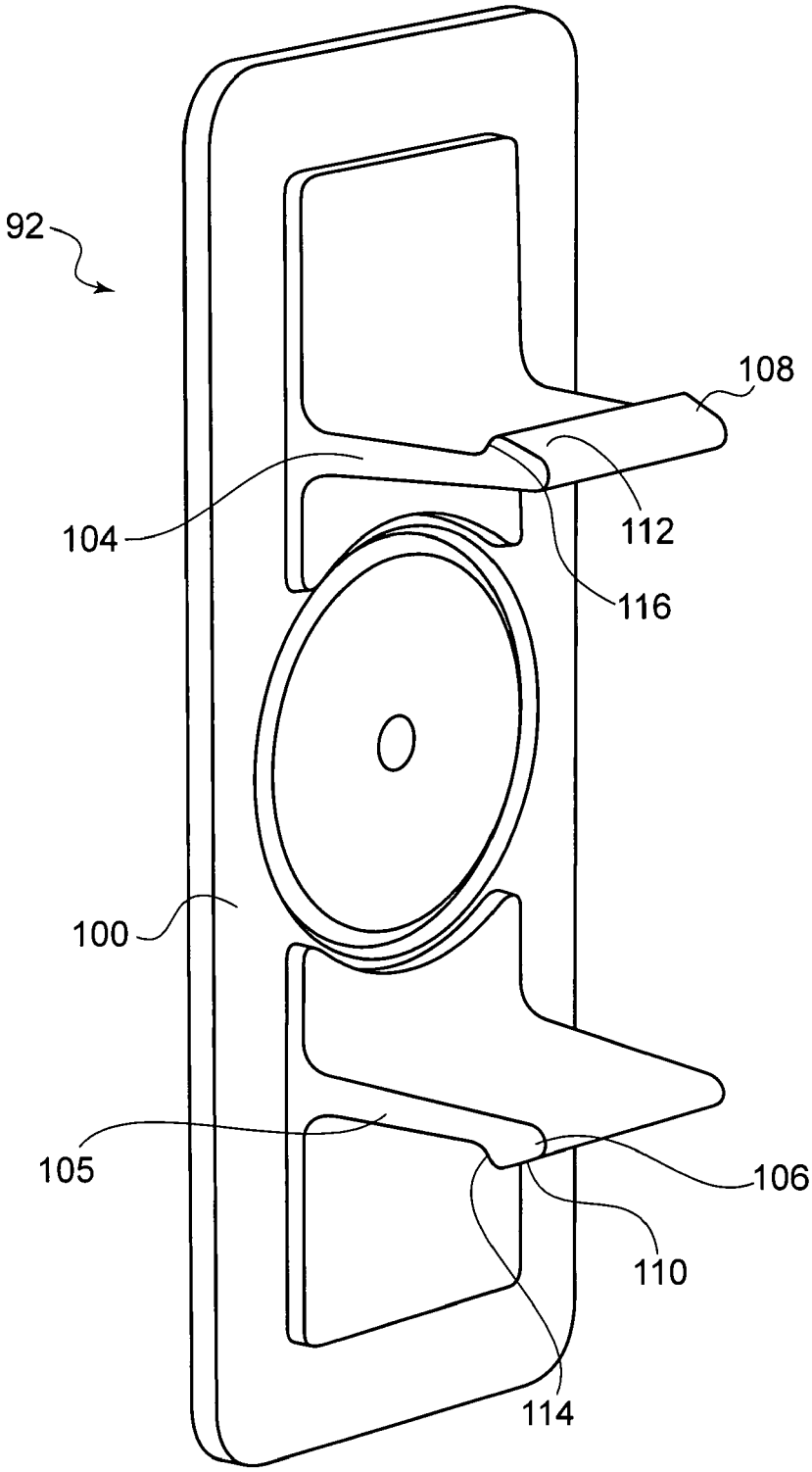
FIG. 25 shows a side perspective view of a plug that may be used to cover a mounting aperture.

FIG. 25 illustrates a plug 92 that may be inserted into an un-used sign mounting opening 90. The plug 92 includes a base 100 from which legs 104, 105 extend. The base 100 is preferably formed from the same material as the sign housing 12 (typically either plastic or metal). While the legs 104, 105 may be formed separately and attached to the base (and thus need not be made from the same material as the base), the legs are preferably integrally-formed with the base.

Figure 26:
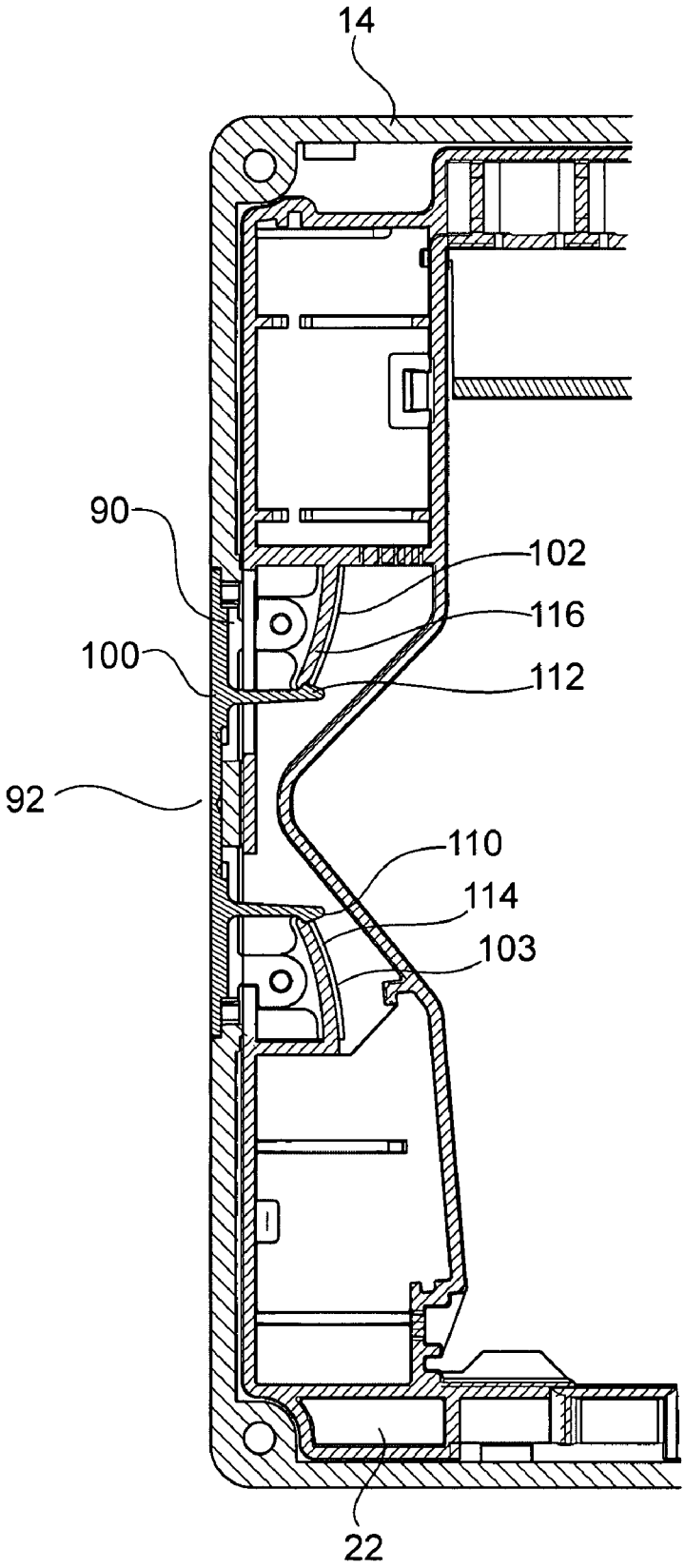
FIG. 26 shows a plug in place in an assembled sign and sign insert combination.

Each leg 104, 105 preferably includes a protrusion 106, 108 respectively on its distal end. Each protrusion includes a ramp 110, 112 and a lip 114, 116. As shown in FIG. 26, when inserting the plug 92 into a sign mounting opening 90, the ramps 110, 112 engage the biasing structure (shown as springs 102, 103) on insert 22, which flex under the pressure, allowing the legs 104, 105 to be inserted further within the housing 12. When the plug 92 is positioned so that the ramps 110, 112 of the legs 104, 105 are beyond the springs 102, 103, the springs 102, 103 abut the lips 114, 116 formed on the underside of protrusion 106, 108. This abutment of the lips 114, 116 with the springs 102, 103 ensures retention of the plug 92 in the sign housing 12. Upon insertion of the plug 92, the outer surface of the plug 92 is preferably flush with the exterior of the housing frame 14.

If an insert is not provided in the sign 10, the lips 114, 116 can abut the inner surface of the housing frame 14 adjacent a sign mounting opening 90. Contact between the lips 114, 116 and the inner surface of the housing frame 14 prevent disengagement of the plug 92 from the sign housing 12, particularly if the hole plug is made of molded plastic.

The foregoing description of the exemplary embodiments of the invention has been presented only for the purposes of illustration and description and is not intended to be exhaustive or to limit the invention to the precise forms disclosed. Many modifications and variations are possible in light of the above teaching. The embodiments were chosen and described in order to explain the principles of the invention and their practical application so as to enable others skilled in the art to utilize the invention and various embodiments and with various modifications, as are suited to the particular use contemplated. Alternative embodiments will become apparent to those skilled in the art to which the present invention pertains without departing from its spirit and scope.

What is claimed is:

1. A removable insert adapted to fit within an illuminated sign comprising a sign housing and a sign legend to be displayed by the illuminated sign, the insert comprising:

(a) at least one inner wall and at least one outer wall, wherein the at least one outer wall is shaped to be inserted into and generally correspond to a shape of a sign housing and wherein the at least one inner wall is shaped so as not to encroach on a sign legend;

(b) a plurality of cavities defined between the at least one inner wall and the at least one outer wall, wherein the plurality of cavities define discrete compartments adapted to house, store, or mount various sign components; and (c) at least one structure for supporting a circuit board.

2. The removable insert of claim 1, wherein the at least one inner wall substantially conforms to an exterior of the sign legend.

3. The removable insert of claim 1, further comprising a light source positioned at either a top or a bottom area of the sign insert and a reflector positioned opposite the light source at the other of the top or bottom of the sign insert.

4. The removable insert of claim 3, wherein the reflector comprises two angled side walls oriented relative to each other and forming a cavity.

5. The removable insert of claim 4, where the angled side walls are oriented between about 40 degrees to about 120 degrees relative to each other.

6. The removable insert of claim 3, wherein the reflector comprises an inverted tip.

7. The removable insert of claim 3, wherein the reflector is integrally formed with the insert, removable from the insert, or hingedly attached to the insert, such that it forms an additional cavity for sign components.

8. The removable insert of claim 1, wherein the insert snap fits into the sign housing.

9. The removable insert of claim 1, wherein the insert snap fits into the sign housing via at least one cooperating protrusion and recess system located on portions of the removable insert and the sign housing.

10. The removable insert of claim 1, wherein the at least one structure that supports the circuit board comprises grooves into which the circuit board can slide.

11. The removable insert of claim 1, wherein the compartments are adapted to store, house, or mount one or more of a battery, a voltage conversion device, an additional power supply, a directional indicator assembly, or a speaker.

12. The removable insert of claim 1, further comprising at least one biasing structure adapted to bear against and exert pressure on a canopy of a mounting device in order to bias the mounting device against a mounting surface.

13. The removable insert of claim 12, wherein the at least one biasing structure is a spring.

14. An illuminated sign system comprising a sign housing and the removable insert of claim 1 positioned within the sign housing.

15. The system of claim 14, further comprising a mounting device comprising:

(a) a mounting plate comprising a mounting base having at least one positioning element and at least one lip element formed thereon;

(b) a canopy element adapted to be positioned over the mounting plate, the canopy element comprising (i) at least one positioning element aperture adapted to receive the at least one positioning element; (ii) at least one lip element aperture adapted to receive the at least one lip element; and (iii) at least one upstanding stabilizing element extending from an upper surface of the canopy; and (c) a locking clip adapted to cooperate with at least a portion of the mounting plate and the canopy element.

16. The system of claim 15, wherein the insert has at least one side wall with at least one guide track defined therein, and wherein the locking clip has at least one leg with at least one tab that is adapted to be received in the at least one guide tack.

17. The removable insert of claim 1, comprising at least one mounting aperture adapted to receive one of a mounting device or a plug that covers any unused mounting apertures.

18. The removable insert of claim 17, wherein the plug comprises a base from which at least one leg extends and wherein the at least one leg comprises a protrusion distal the base and adapted to engage a biasing structure on the sign insert.

19. A method of assembling an illuminated sign comprising:

(a) providing a first sign housing;

(b) providing a first removable sign insert according to claim 1; and (c) positioning the first removable insert in the first sign housing.

20. The method of claim 19, further comprising:

(d) providing a second sign housing;

(e) removing the first removable insert from the first sign housing and positioning the first removable insert in the second sign housing.

21. The method of claim 19, further comprising:

(d) providing a second removable insert;

(e) removing the first removable insert from the first sign housing and positioning the second removable insert into the first sign housing.

22. The method of claim 19, wherein the first removable insert is adapted to be snap fit with respect to the first sign housing.

23. The removable insert of claim 1, wherein the insert comprises a polymeric material and wherein the sign housing comprises a metal housing.

* * * * *